US010513871B2

(12) United States Patent
Wang et al.

(10) Patent No.: US 10,513,871 B2
(45) Date of Patent: Dec. 24, 2019

(54) KNOB LOCK AND LOCK BOX HAVING THE SAME

(71) Applicant: SINOX CO., LTD, New Taipei (TW)

(72) Inventors: Chih-Lun Wang, New Taipei (TW); Chia-Hung Wang, New Taipei (TW)

(73) Assignee: SINOX CO., LTD, New Taipei (TW)

( * ) Notice: Subject to any disclaimer, the term of this patent is extended or adjusted under 35 U.S.C. 154(b) by 71 days.

(21) Appl. No.: 15/670,727

(22) Filed: Aug. 7, 2017

(65) Prior Publication Data

US 2018/0038133 A1 Feb. 8, 2018

(30) Foreign Application Priority Data

Aug. 8, 2016 (CN) ..... 2016 2 0848095 U

(51) Int. Cl.

| | |
|---|---|
| ***E05B 37/02*** | (2006.01) |
| ***E05B 1/00*** | (2006.01) |
| ***E05B 19/00*** | (2006.01) |
| ***E05B 37/00*** | (2006.01) |
| ***E05B 37/08*** | (2006.01) |

(52) U.S. Cl.

CPC ..... *E05B 37/02* (2013.01); *E05B 1/003* (2013.01); *E05B 19/0005* (2013.01); *E05B 37/0048* (2013.01); *E05B 37/08* (2013.01); *E05B 37/0068* (2013.01)

(58) Field of Classification Search

CPC . E05B 1/00; E05B 1/003; E05B 37/00; E05B 37/02; E05B 37/0048; E05B 37/0068; E05B 37/025

See application file for complete search history.

(56) References Cited

U.S. PATENT DOCUMENTS

| | | | | |
|---|---|---|---|---|
| 4,770,013 | A * | 9/1988 | Nakai | E05B 37/02 70/285 |
| 5,345,798 | A * | 9/1994 | Nakai | E05B 37/0034 70/284 |
| 6,508,089 | B1 * | 1/2003 | Tsai | E05B 37/0034 70/213 |
| 6,598,434 | B2 * | 7/2003 | Yang | E05B 37/02 70/213 |
| 7,290,417 | B1 * | 11/2007 | Huang | E05B 37/02 70/285 |
| 7,437,903 | B2 * | 10/2008 | Cheng | E05B 37/0034 70/284 |
| 7,444,844 | B1 * | 11/2008 | Lee | E05B 37/0034 70/21 |
| 8,113,024 | B2 * | 2/2012 | Yang | E05B 37/0034 70/21 |

(Continued)

*Primary Examiner* — Christopher J Boswell
(74) *Attorney, Agent, or Firm* — Innovation Capital Law Group, LLP; Vic Lin

(57) ABSTRACT

The knob lock of the present invention includes a knob, a first driving unit disposed on the knob, a driving barrel, a second driving unit, a lock unit, and a lock core. When the lock core is in a locked state, the driving barrel is restricted from rotating by the lock core, and the knob rotates alone with respect to the driving barrel. When the lock core is in an unlocked state, the restriction to the rotation of the driving barrel by the lock core is removed, the first driving unit applies a driving force on the second driving unit when the knob rotates, and the driving force rotates the driving barrel to make the lock unit rotate together.

14 Claims, 27 Drawing Sheets

(56) References Cited

U.S. PATENT DOCUMENTS

| | | | | |
|---|---|---|---|---|
| 2004/0011098 | A1* | 1/2004 | Yang | E05B 13/002 70/284 |
| 2007/0214850 | A1* | 9/2007 | Ma | E05B 35/105 70/284 |
| 2009/0301147 | A1* | 12/2009 | Yang | E05B 13/004 70/284 |
| 2010/0313616 | A1* | 12/2010 | Lee | E05B 13/002 70/332 |
| 2011/0041574 | A1* | 2/2011 | Yang | E05B 37/02 70/315 |

* cited by examiner

KNOB LOCK AND LOCK BOX HAVING THE SAME

BACKGROUND OF THE INVENTION

1. Field of the Invention

The present invention relates generally to a knob lock and a lock box having the same.

2. Description of the Prior Art

In public places such as a market, campus, station, gym, and etc., in order to display or deposit objects, a lock would be installed on a cabinet to prevent stealing or taking the object by mistake.

A conventional lock as shown in FIG. 1 is typically used in the above mentioned public places for beauty and/or convenient operation. The conventional knob lock 90 includes a knob 30, a tongue piece 50, and a lock core 60. The tongue piece 50 connects to the knob 30 via the pivot 53. Accordingly, a user is able to drive the tongue piece 50 rotate to reach or leave an engaging position of a cabinet by rotating the knob 30. The lock core 60 connects to the tongue piece 50. The lock core 60 restricts the tongue piece 50 from rotating when the lock core is in a locked state.

However, while using the conventional knob lock, the connection between the knob 30 and the tongue piece 50 would be damaged if the user rotates the knob 30 forcibly when the lock core 60 is in the locked state and hence results the knob lock 90 not functional anymore.

SUMMARY OF THE INVENTION

It is an object of the present invention to provide a knob lock and a lock box having the same to resolve the issues of the prior arts.

The knob lock includes a knob, a first driving unit, a driving barrel, a second driving unit, a lock unit, a combination lock shaft, a plurality of discs, a plurality of heart cams, a barrel rotating unit, a reset unit shaft, a first arm, and a plurality of second arms. The knob is able to rotate on its axis which is along a first direction. The first driving unit is disposed on the knob. The driving barrel is disposed on one side of the knob, wherein the driving barrel is able to rotate on its axis which is along the first direction. The second driving unit is disposed on the driving barrel. The lock unit is disposed on the other side of the driving barrel with respect to the knob, wherein the lock unit rotates together with the driving barrel. The combination lock shaft is disposed along a shaft direction perpendicular to the first direction, wherein one end of the combination lock shaft connects to the driving barrel. The plurality of discs are disposed on the combination lock shaft. The plurality of heart cams are disposed on the combination lock shaft and respectively fixed on one side of the plurality of discs. The barrel rotating unit pivotally connects to one end of the driving barrel, wherein the barrel rotating unit is able to rotate together with the driving barrel on its axis which is along the first direction, wherein the barrel rotating unit includes an external surface and a driving slot disposed on the external surface. The reset unit shaft extends along the shaft direction, wherein the reset unit shaft is disposed in one side of the plurality of discs. One end of the first arm connects to an end of the reset unit shaft close to the barrel rotating unit, wherein the other end of the first arm extends into the driving slot. The plurality of second arms are respectively disposed outside the plurality of heart cams, wherein the plurality of second arms are able to engage the outer edges of the plurality of heart cams. When the knob lock is in a locked state, the driving barrel is restricted from rotating, and the knob rotates alone with respect to the driving barrel. When the knob lock is in an unlocked state, the restriction to the rotation of the driving barrel is removed, the first driving unit applies a driving force on the second driving unit when the knob rotates, and the driving force drives the driving barrel rotate to make the lock unit rotate together. When the barrel rotating unit rotates to a reset position, the driving slot drives the first arm to make the reset unit shaft rotate and to make the second arms engage respectively the outer edges of the corresponding heart cams, and the second arms apply force to the heart cams and make the heart cams bring the respective connected discs to rotate to a pre-determined position.

In one embodiment of the present invention, the knob lock includes a knob, a first driving unit disposed on the knob, a driving barrel, a second driving unit, a lock unit, and a lock core. The first driving unit is disposed on the knob. The driving barrel is disposed in one side of the knob, wherein the driving barrel and the knob are able to rotate on the same axis. The second driving unit is disposed on the driving barrel. The lock unit is disposed on the other side of the driving barrel with respect to the knob, wherein the lock unit rotates together with the driving barrel. The lock core is disposed beside the driving barrel. When the lock core is in a locked state, the driving barrel is restricted from rotating by the lock core, the knob rotates alone with respect to the driving barrel When the lock core is in an unlocked state, the restriction to the rotation of the driving barrel by the lock core is removed, the first driving unit applies a driving force on the second driving unit when the knob rotates, and the driving force drives the driving barrel rotate to make the lock unit rotate together.

In one embodiment of the present invention, one side of the knob has a fixed part disposed along the axial direction of the knob. The first driving unit is disposed along the radial direction of the knob. The first driving unit includes an elastic unit. The opposite ends of the elastic unit are respectively a connecting end and a driving end. The connecting end connects to the fixed part. The driving barrel circles the fixed part and the first driving unit. The second driving unit forms a concave on the inner side of the circular wall of the driving barrel, wherein the driving end extends into the concave. When the lock core is in a locked state, the driving barrel is restricted from rotating by the lock core. The knob rotates alone with respect to the driving barrel and makes the driving end depart from the concave. When the lock core is in an unlocked state, the restriction to the rotation of the driving barrel by the lock core is removed. The driving end applies a force on the side wall of the concave to generate the driving force to rotate the driving barrel.

In one embodiment of the present invention, the elastic unit includes a spring, wherein a ball is disposed at one end of the spring to serve as the driving end.

In one embodiment of the present invention, one side of the knob has a fixed part disposed along the axial direction of the knob. The first driving unit is disposed along the radial direction of the knob. The opposite ends of the first driving unit are respectively a connecting end and a first magnetic unit. The connecting end connects to the fixed part. The driving barrel circles the fixed part and the first driving unit. The second driving unit includes a second magnetic unit disposed on the inner side of the circular wall of the driving barrel. There is a first magnetic attraction force between the first magnetic unit and the second magnetic unit. When the lock core is in a locked state, the driving barrel is restricted from rotating by the lock core. The knob rotates alone with respect to the driving barrel. When the lock core is in an unlocked state, the restriction to the rotation of the driving barrel by the lock core is removed. The first magnetic unit takes the first magnetic attraction force as the driving force to make the second magnetic unit move together with the first magnetic unit and rotates the driving barrel.

In one embodiment of the present invention, the lock unit includes a tongue piece and a lock barrel. The lock barrel is disposed on the other side of the driving barrel with respect to the knob. The lock barrel and the driving barrel are able to rotate on the same axis. One side of the lock barrel facing the driving barrel has an inserting hole. The other side of the lock barrel with respect to the driving barrel connects to the tongue piece. The other side of the driving barrel with respect to the knob has an inserting pin, wherein the inserting pin inserts into the inserting hole.

In one embodiment of the present invention, the lock core includes a combination lock shaft and a plurality of discs. The combination lock shaft is disposed along a shaft direction, wherein the combination lock shaft has a shaft end. The plurality of discs are disposed respectively on the combination lock shaft. The shaft end engages the outer side of the circular wall of the driving barrel, wherein the outer side of the circular wall of the driving barrel has a driving protruding portion. When the lock core is in a locked state, the movement of the combination lock shaft along the shaft direction is restricted. The pushing of the combination lock shaft by the driving protruding portion is stopped to restrict the driving barrel from rotating. When the lock core is in an unlocked state, the driving protruding portion is able to push the combination lock shaft to move along the shaft direction while the driving barrel rotates.

In one embodiment of the present invention, the driving barrel is able to rotate on its axis which is along a first direction, wherein the shaft direction is perpendicular to the first direction. The shaft end connects to the driving barrel. The lock core further includes a plurality of heart cams disposed on the combination lock shaft and respectively fixed on one side of the plurality of discs. The knob lock further includes a reset device, wherein the reset device includes a barrel rotating unit, a reset unit shaft, a first arm, and a plurality of second arms. The barrel rotating unit is pivotally connected to one end of the driving barrel, wherein the barrel rotating unit is able to rotate together with the driving barrel on its axis which is along the first direction. The barrel rotating unit includes an external surface and a driving slot disposed on the external surface. The reset unit shaft extends along the shaft direction, wherein the reset unit shaft is disposed in one side of the plurality of discs. One end of the first arm connects to an end of the reset unit shaft close to the barrel rotating unit, wherein the other end of the first arm extends into the driving slot. A plurality of second arms are respectively disposed outside the plurality of heart cams, wherein the plurality of second arms are able to engage the outer edges of the plurality of heart cams. When the barrel rotating unit rotates to a reset position, the driving slot drives the first arm to make the reset unit shaft rotate and to make the second arms engage respectively the outer edges of the corresponding heart cams. The second arms apply force to the heart cams and make the heart cams bring the respective connected discs to rotate to a pre-determined position.

In one embodiment of the present invention, the outer edge of the heart cams fit involute curves.

In one embodiment of the present invention, a first inclined plane is formed on the inner side wall of the driving slot. The other end of the first arm moves to the first inclined plane when the barrel rotating unit rotates to the reset position.

In one embodiment of the present invention, a slot protruding portion is formed on the inner side wall of the driving slot. The other end of the first arm moves to the slot protruding portion when the barrel rotating unit rotates to the reset position.

In one embodiment of the present invention, the reset device further includes a plurality of engaging arms respectively disposed outside the plurality of discs. The plurality of engaging arms are able to engage the external surfaces of the plurality of discs. The engaging arms are elastic and are able to provide a first resistance to the rotating of the discs.

In one embodiment of the present invention, the external surface of the discs further have a plurality of concave portions. The engaging arms are able to provide a second resistance to the rotating of the discs when one end of each of the engaging arms engages the concave portion, wherein the second resistance is larger than the first resistance.

In one embodiment of the present invention, the knob lock can be used in a lock box. The lock box includes a box, a hook device, and the knob lock. The box includes a concave body and a front cover. The front cover forms an accommodating space with the concave body. The bottom edge of the front cover connects pivotally to the bottom side of the concave body. The front cover is able to rotate to open with respect to the concave body. The front cover has a knob opening and a plurality of disc openings. The hook device is disposed at the top of the concave body. The knob lock is disposed in the inner side of the front cover. The knob and the plurality of discs are at least partially exposed by the knob opening and the disc openings. When the knob lock is in an unlocked state, the knob makes the lock unit rotate together while the knob rotates and makes the hook device unlock.

Accordingly, the knob lock of the present invention would not be easily damaged.

The above description and the following embodiments are merely illustrative and make no limitation to the scope of the invention as defined by the appended claims.

DETAILED DESCRIPTION OF THE PREFERRED EMBODIMENT

Figure 1:
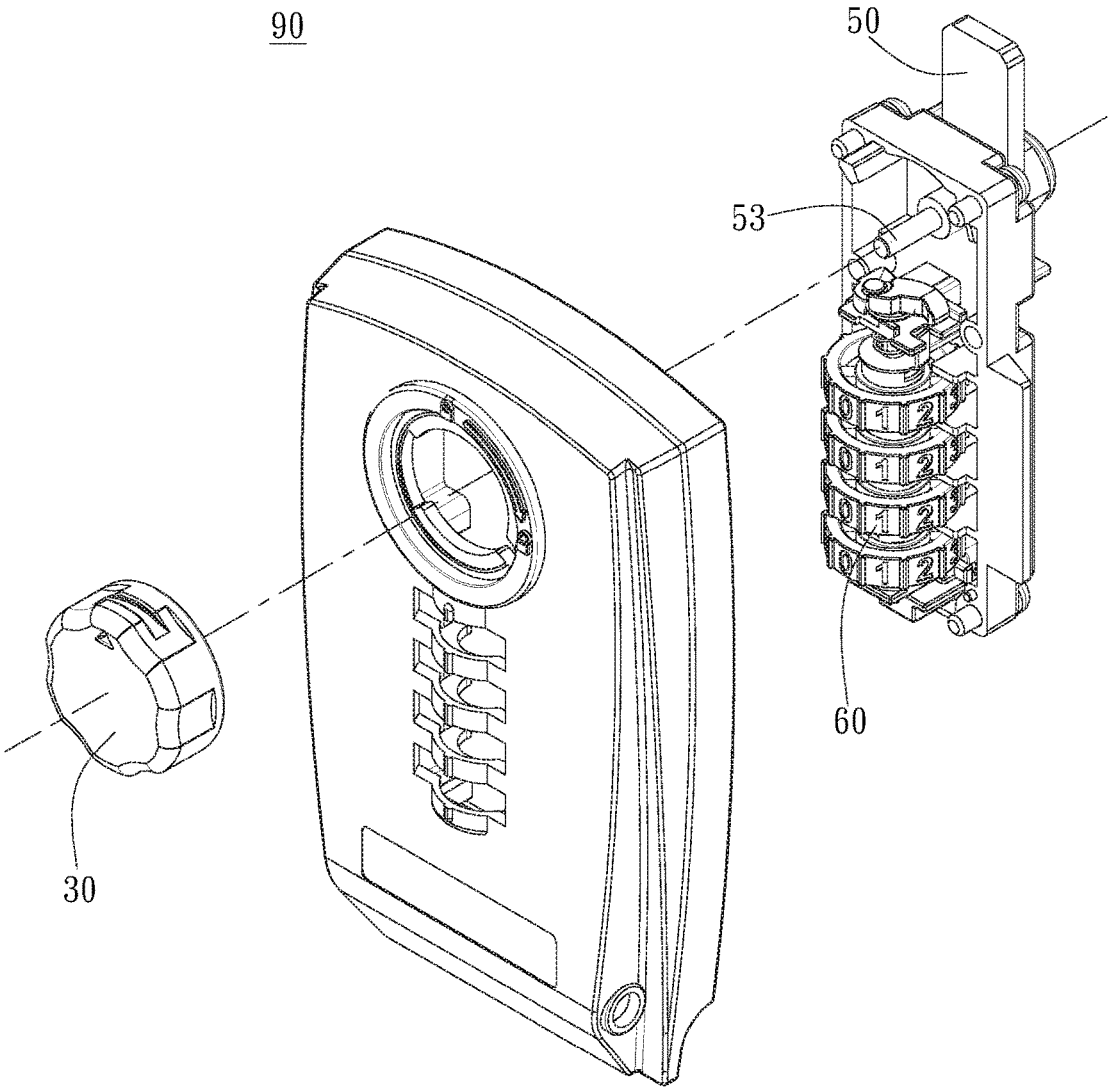
FIG. 1 (PRIOR ART)
FIG. 1 is a perspective view of a prior art.
Figure 2:
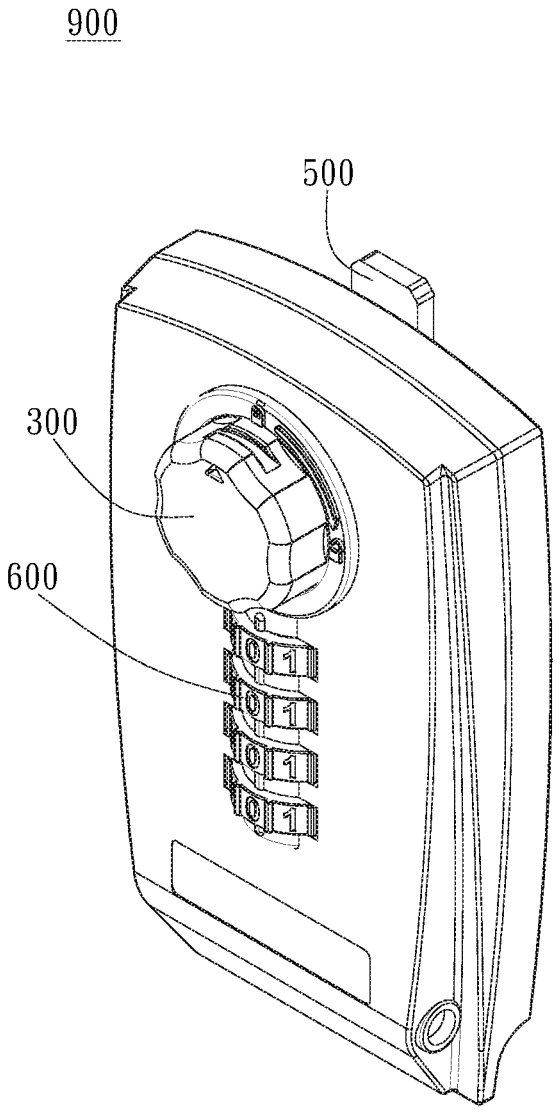
FIG. 2 is a perspective view of an embodiment of the knob lock of the present invention.

As shown in FIG. 2, the present invention relates to a knob lock 900 which is easily operated and would not be damaged by rotating forcibly the knob 300. In a preferable embodiment, the knob lock 900 is used as a cabinet lock. In other embodiments, however, the knob lock 900 could be used as a window lock, a shop window lock, or a furniture lock, etc.

Figure 3A:
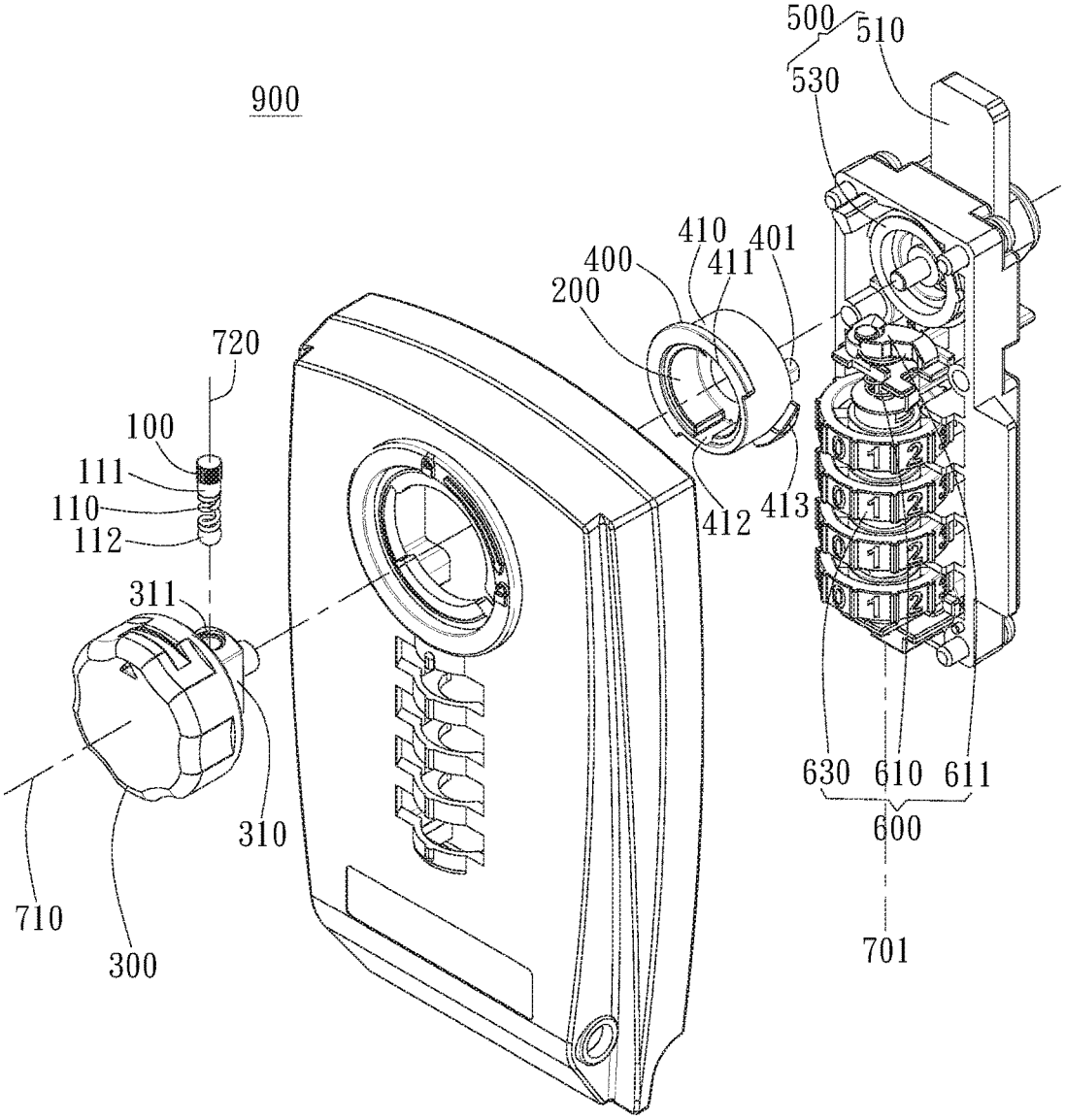
FIGS. 3A and 3B are exploded views of an embodiment of the knob lock of the present invention.
Figure 3B:
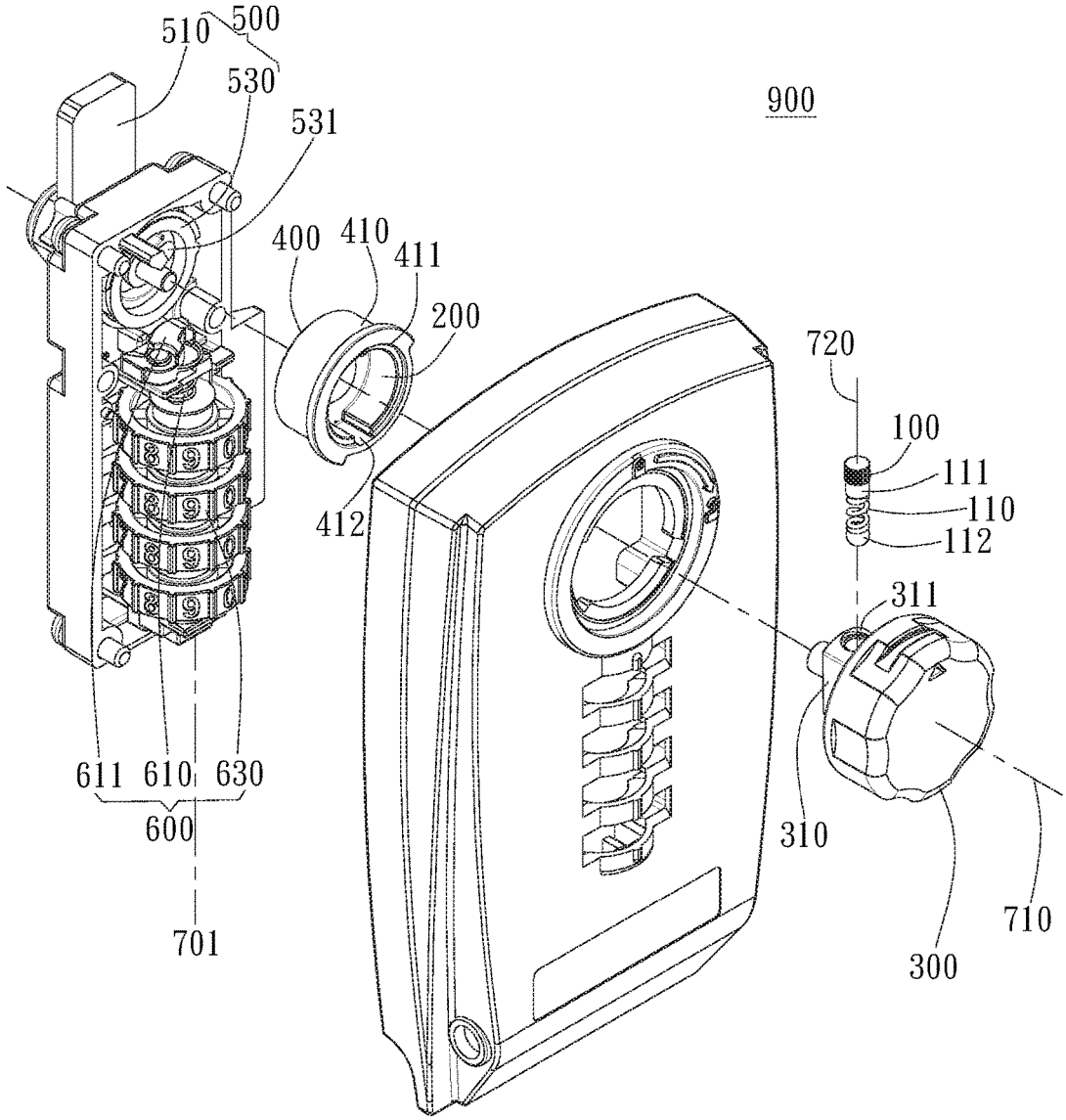

As the exploded views of an embodiment of the knob lock of the present invention shown in FIGS. 3A and 3B, the knob lock 900 includes a knob 300, a first driving unit 100, a second driving unit 200, a driving barrel 400, a lock unit 500, and a lock core 600. The first driving unit 100 is disposed on the knob 300. More particularly, as the embodiment shown in FIGS. 3A and 3B, one side of the knob 300 has a fixed part 310 disposed along the axial direction of the knob 300. The first driving unit 100 is disposed along the radial direction 720 of the knob 300. The first driving unit 100 includes an elastic unit 110. The opposite ends of the elastic unit 110 are respectively a connecting end 111 and a driving end 112. The connecting end 111 connects to the fixed part 310. As the embodiment shown in FIGS. 3A and 3B, the connecting end 111 is able to connect to the fixed part 310 by engaging into the fixing hole 311 of the fixed part 310. In different embodiments, however, the connecting end 111 could connect to the fixed part 310 through welding, screwing, gluing, and etc. The driving end 112 is exposed by the fixed part 310.

As shown in the embodiment in FIGS. 3*a* and 3B, the driving barrel 400 is disposed in one side of the knob 300, wherein the driving barrel 400 and the knob 300 are able to rotate on the same axis 710. The second driving unit 200 is disposed on the driving barrel 400. More particularly, the driving barrel 400 circles the fixed part 310 and the first driving unit 100. The second driving unit 200 forms a concave 412 on the inner side 411 of the circular wall 410 of the driving barrel 400. In this embodiment, the second driving unit 200 is a non-continuous stopping plate attached on the inner side 411 of the circular wall 410, wherein a portion of the inner side 411 of the circular wall 410 exposed by the non-continuous portion of the second driving unit 200 forms the concave 412. In different embodiments, however, the second driving unit 200 and the driving barrel 400 could be formed as one piece. In other words, the concave 412 can be formed directly on the inner side 411 of the circular wall 410 of the driving barrel 400. In this situation, the inner side of the circular wall 410 of the driving barrel 400 could be deemed as the second driving unit 200.

Figure 4A:
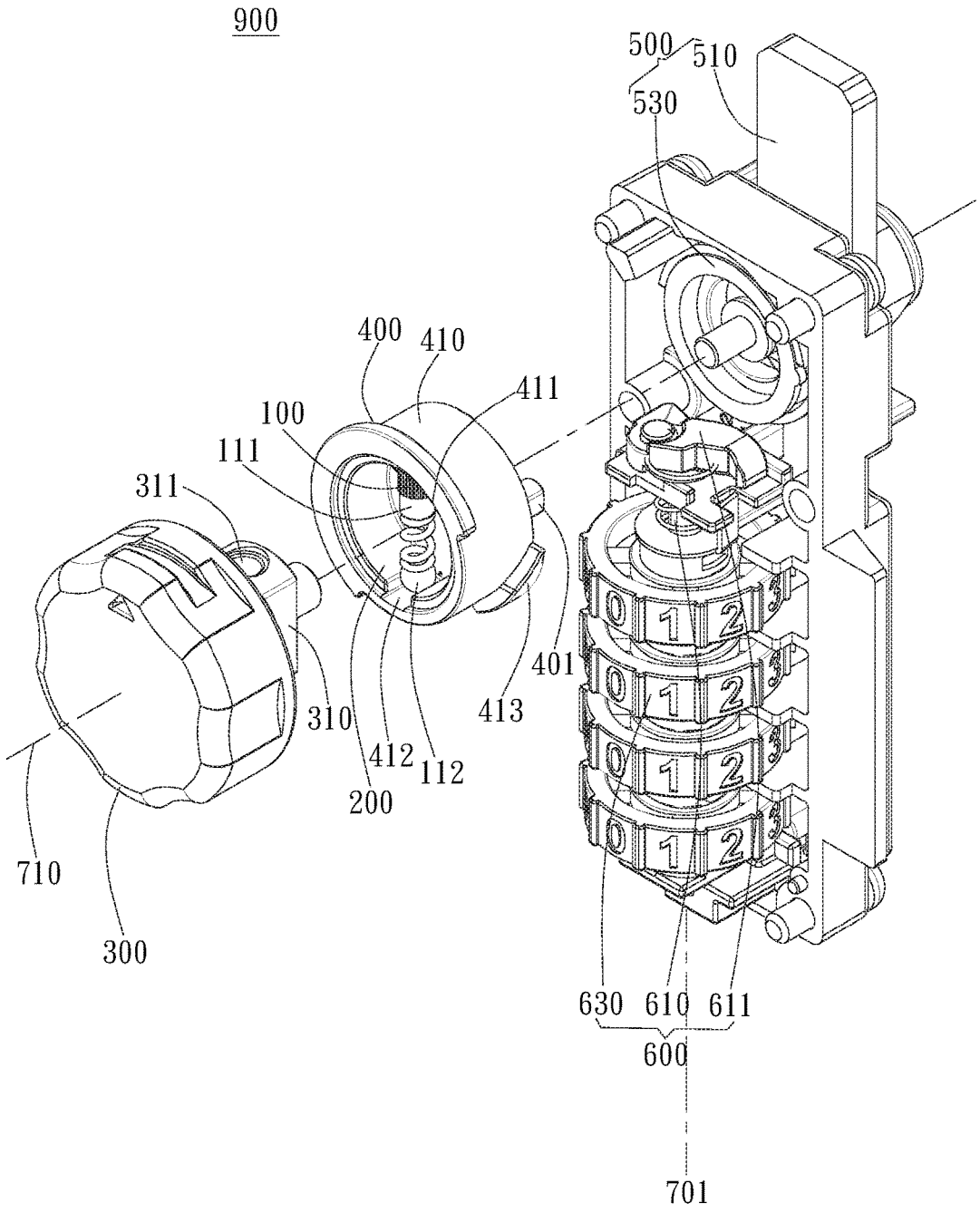
FIGS. 4A and 4B are perspective views of an embodiment of the knob lock of the present invention having the first driving unit in the driving barrel.
Figure 4B:
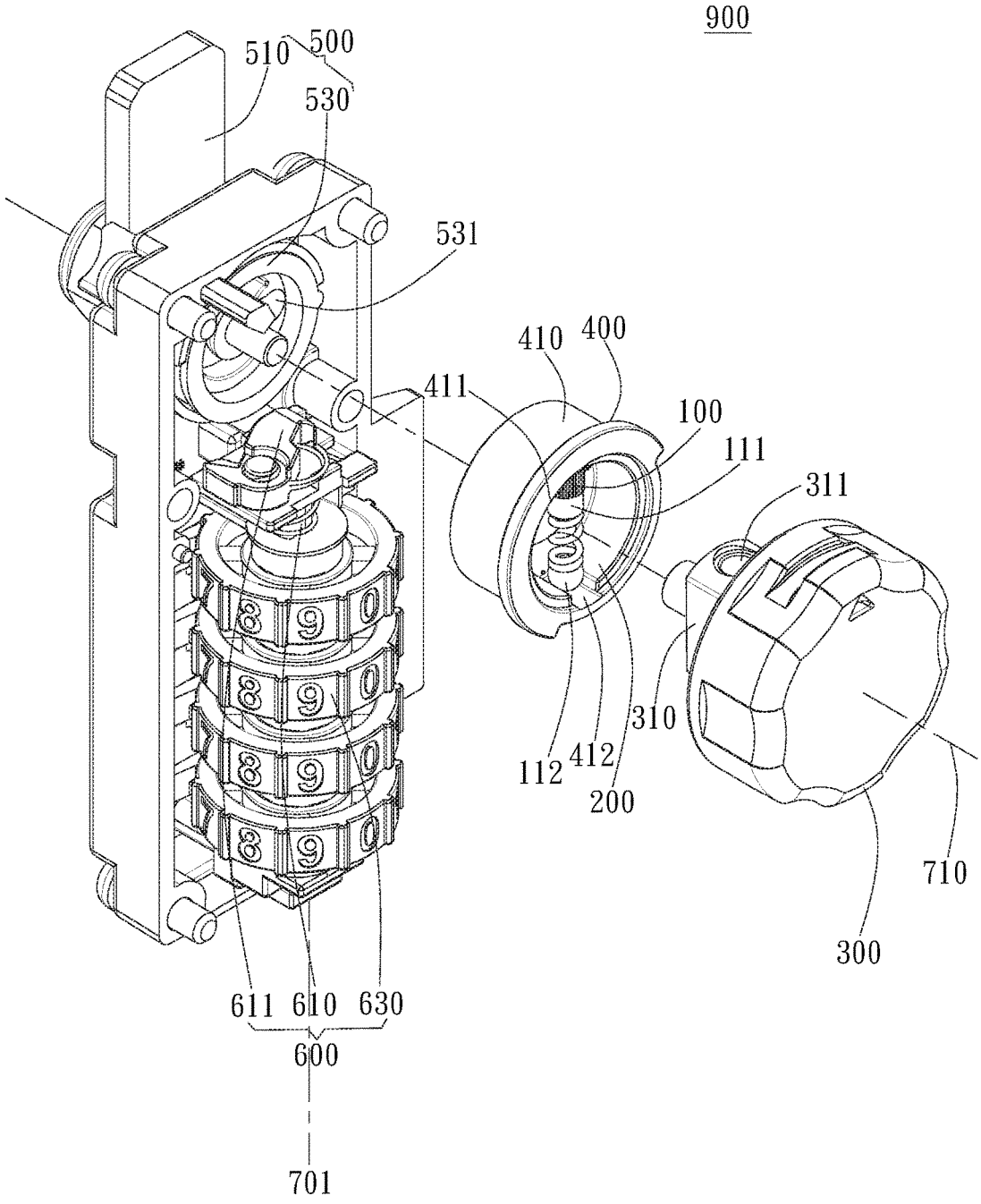

For the convenience of describing and understanding the relative position between the second driving unit 200 and the driving barrel 400 in the assembled knob lock 900, the second driving unit 200 is sketched directly in the driving barrel 400 as shown in FIGS. 4A and 4B. However, the actual relative position between the two would refer to the embodiment shown in FIGS. 3A and 3B. As the embodiment shown in FIGS. 4A and 4B, the driving end 112 extends into the concave 412. More particularly, in the assembled knob lock 900, the driving barrel 400 circles the fixed part 310 and the first driving unit 100, wherein the driving end 112 of the first driving end 100 extends toward the inner side 411 of the circular wall 410 of the driving barrel 400 and into the concave 412. Accordingly, the driving end 100 applies a driving force on the second driving unit 200 when the knob 300 rotates.

As shown in the embodiment in FIGS. 3A to 4B, the lock unit 500 is disposed on the other side of the driving barrel 400 with respect to the knob 300, wherein the lock unit 500 rotates together with the driving barrel 400. More particularly, in this embodiment, the lock unit 500 includes a tongue piece 510 and a lock barrel 530. The lock barrel 530 is disposed on the other side of the driving barrel 400 with respect to the knob 300. The lock barrel 530 and the driving barrel 400 are able to rotate on the same axis 710. One side of the lock barrel 530 facing the driving barrel 400 has an inserting hole 531 (see FIG. 4B). The other side of the lock barrel 530 with respect to the driving barrel 400 connects to the tongue piece 510. The other side of the driving barrel 400 with respect to the knob 300 has an inserting pin 401 (see FIG. 4A). In the assembled knob lock 900, the inserting pin 401 inserts into the inserting hole 531. Accordingly, when the driving barrel 400 rotates, it drives the lock barrel 530 to rotate together and hence make the lock unit 500 connecting to the lock barrel 530 rotate together. In different embodiments, however, the driving barrel 400 could connect to the lock unit 500 through different approaches, such as pivotally connecting, to make the lock unit 500 rotate together.

As shown in the embodiment in FIGS. 3A to 4B, in the assembled knob lock 900, the lock core 600 is disposed beside the driving barrel 400. When the lock core 600 is in a locked state, the driving barrel 400 is restricted from rotating by the lock core 600, wherein the knob 300 rotates alone with respect to the driving barrel 400. When the lock core 600 is in an unlocked state, the restriction to the rotation of the driving barrel 400 by the lock core 600 is removed. Hence, the driving force rotates the driving barrel 400 to make the lock unit 500 rotate together.

Figure 5A:
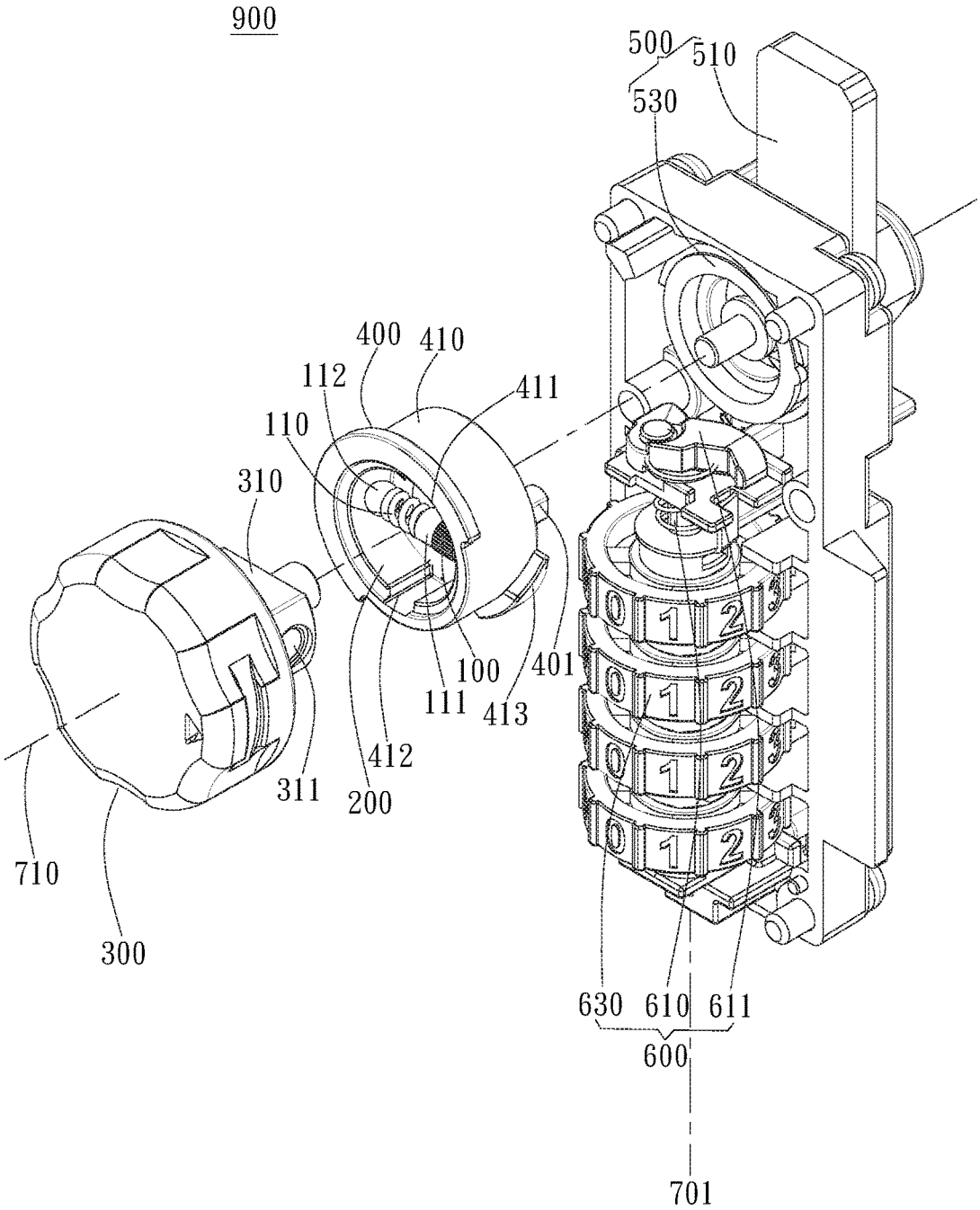
FIGS. 5A to 6B are perspective views showing the movement of the knob lock of the present invention.
Figure 5B:
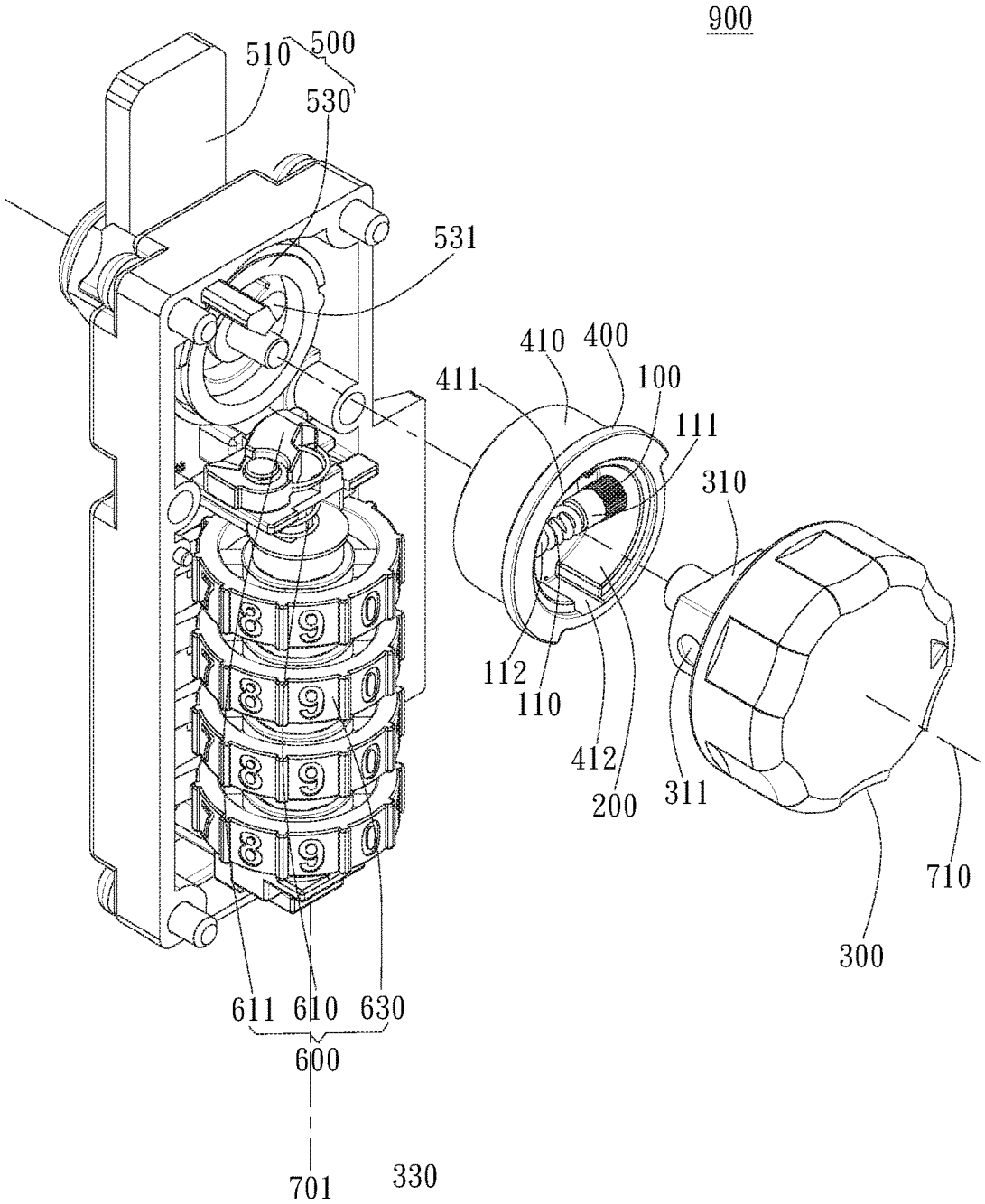
Figure 6A:
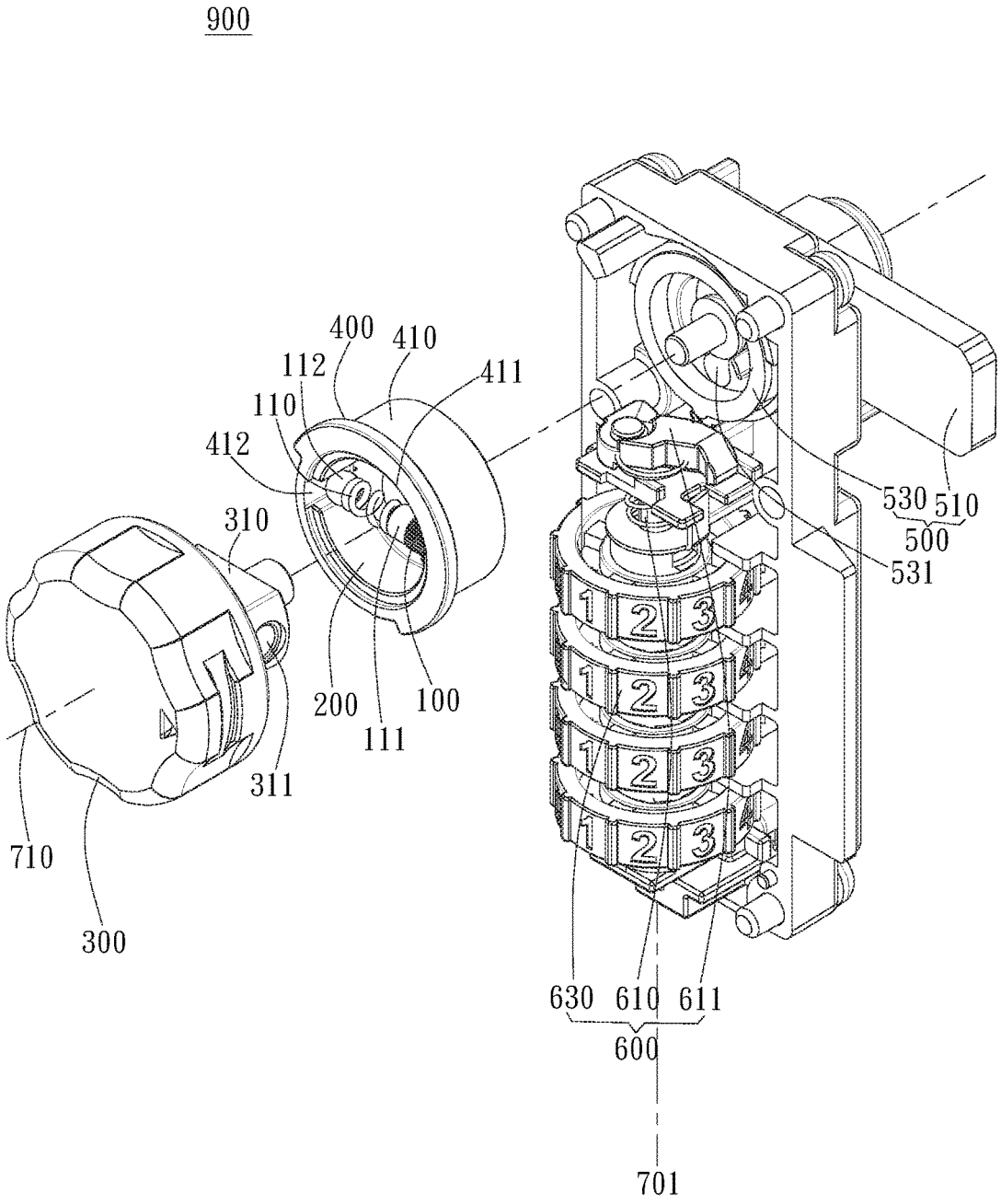
Figure 6B:
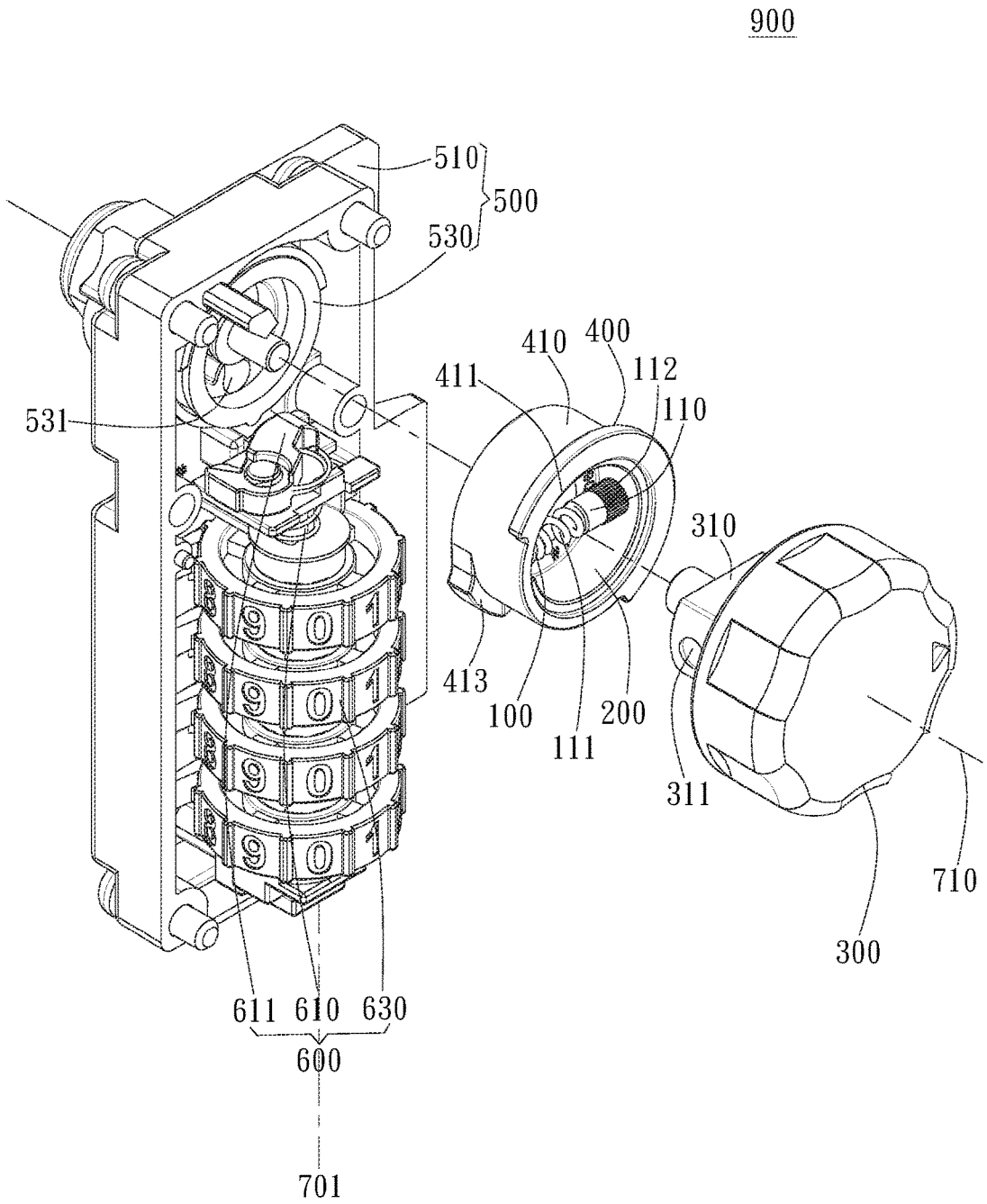

More particularly, in this embodiment, the lock core 600 is a combination lock core. The lock core 600 includes a combination lock shaft 610 and a plurality of discs 630. The combination lock shaft 610 is disposed along a shaft direction 701, wherein the combination lock shaft 610 has a shaft end 611. The shaft direction 701 is preferably perpendicular to the axis 710. The plurality of discs 630 are disposed respectively on the combination lock shaft 610. The shaft end 611 engages the outer side of the circular wall 410 of the driving barrel 400, wherein the outer side of the circular wall 410 of the driving barrel 400 has a driving protruding portion 413. When the lock core 600 is in a locked state (e.g. the numbers are wrong, the discs 630 were not rotated to a locked position), the movement of the combination lock shaft 610 along the shaft direction 701 is restricted. The pushing of the combination lock shaft 610 by the driving protruding portion 413 is stopped to restrict the driving barrel 400 from rotating. At this time, if the user rotates continuously the knob 300, the driving end 112 would leave the concave 412 as shown in FIGS. 5A and 5B since the driving end 112 is a ball having curved surface and the spring is deformable. Thus, the knob 300 rotates alone with respect to the driving barrel 400. When the lock core 600 is in an unlocked state (e.g. the numbers are correct, the discs 630 were rotated to an unlocked position), the driving protruding portion 413 is able to push the combination lock shaft 610 to move along the shaft direction 701 while the driving barrel 400 rotates. In other words, if the user rotates continuously the knob 300, the driving end 112 applies a force on the side wall of the concave 412 to generate the driving force. Since the driving barrel 400 is not restricted from rotating by the combination lock shaft 610, the driving force could make the driving barrel 400 rotate. At this time, the knob 300 is able to make the driving barrel 400 and the lock unit 500 rotate as shown in FIGS. 6A and 6B.

From the above, the knob 300 of the knob lock 900 of the present invention makes the driving barrel 400 and the lock unit 500 rotate only when the lock core 600 is in the unlocked state. If the user rotates forcibly the knob 300 when the lock core 600 is in the locked state, the knob 300 rotates alone with respect to the driving barrel 400. Accordingly, a damage to the connection between the knob 300 and the driving barrel 400 or the lock unit 500 resulted by rotating forcibly the knob 300 when the lock core 600 is in the locked state, as like that in prior arts, could be prevented.

Figure 7A:
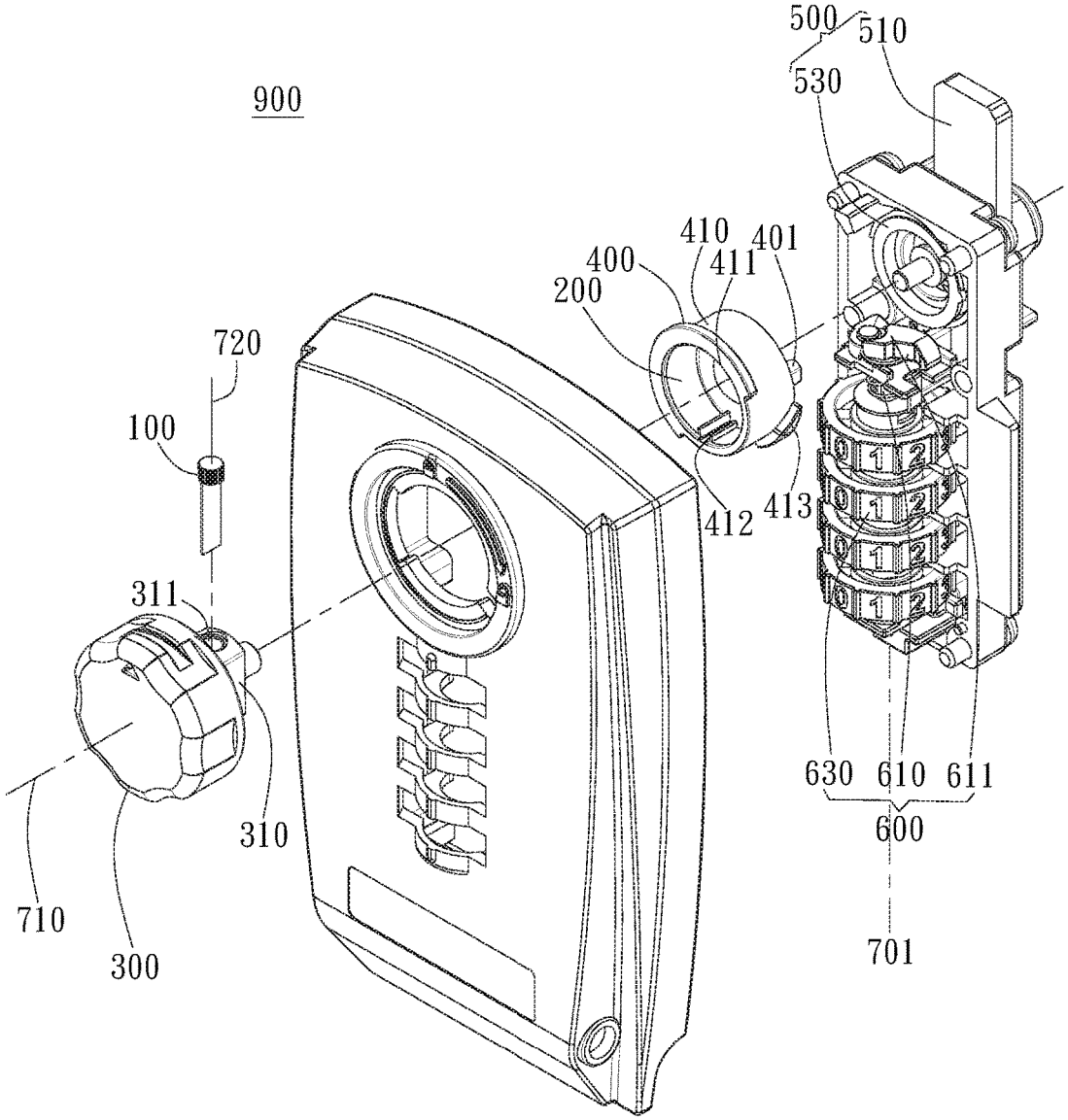
FIGS. 7A and 7B are perspective views of a different embodiment of the knob lock of the present invention.
Figure 7B:
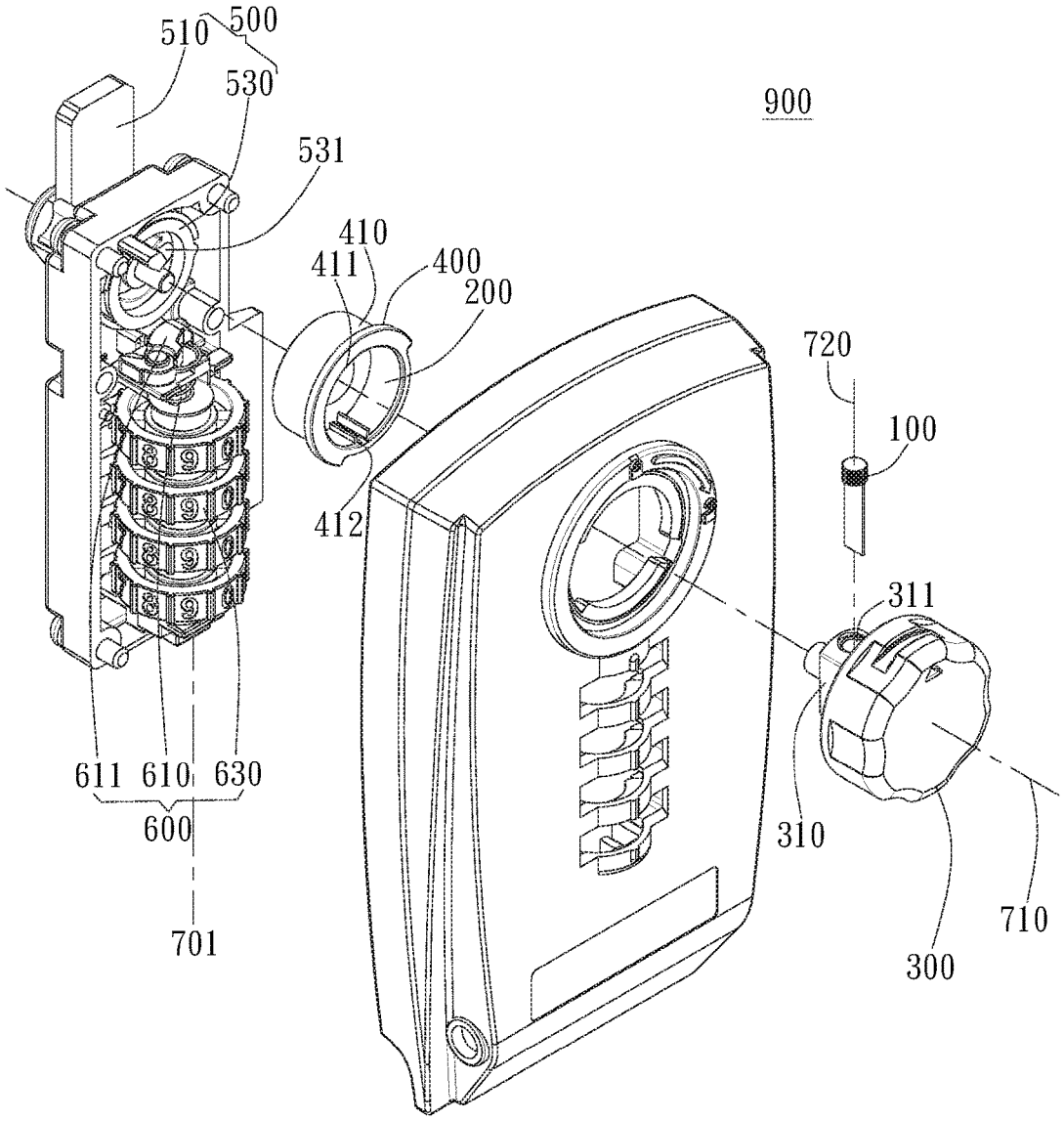

As shown in the embodiment in FIGS. 2 to 6B, the elastic unit 100 includes a spring, wherein a ball is disposed at one end of the spring to serve as the driving end 112. In different embodiments, the elastic unit 100 is not limited to a spring and could have different setup considering the manufacturing and design demand. For example, as the embodiment shown in FIGS. 7A and 7B, the elastic unit 100 includes an elastic plate. More particularly, when the lock core 600 is in a locked state, the movement of the combination lock shaft 610 along the shaft direction 701 is restricted. The pushing of the combination lock shaft 610 by the driving protruding portion 413 is stopped to restrict the driving barrel 400 from rotating. At this time, if the user rotates continuously the knob 300, the free end of the elastic plate would leave the concave 412 since the elastic plate of the elastic unit 100 is deformable. Thus, the knob 300 rotates alone with respect to the driving barrel 400. When the lock core 600 is in an unlocked state, the driving protruding portion 413 is able to push the combination lock shaft 610 to move along the shaft direction 701 while the driving barrel 400 rotates. In other words, if the user rotates continuously the knob 300, the free end of the elastic plate applies a force on the side wall of the concave 412 to generate the driving force. Since the driving barrel 400 is not restricted from rotating by the combination lock shaft 610, the driving force could rotate the driving barrel 400. At this time, the knob 300 is able to make the driving barrel 400 and the lock unit 500 rotate.

As shown in the embodiments in FIGS. 2 to 7B, the first driving unit 100 contacts with the second driving unit 200, wherein the applied driving force is a contact force. In different embodiments, however, the first driving unit 100 does not contact with the second driving unit 200, wherein the applied driving force is a non-contact force. For example, two attractive magnets are respectively used as the first driving unit 100 and the second driving unit 200, wherein the magnetic attraction force between the two is taken as the driving force.

Figure 8A:
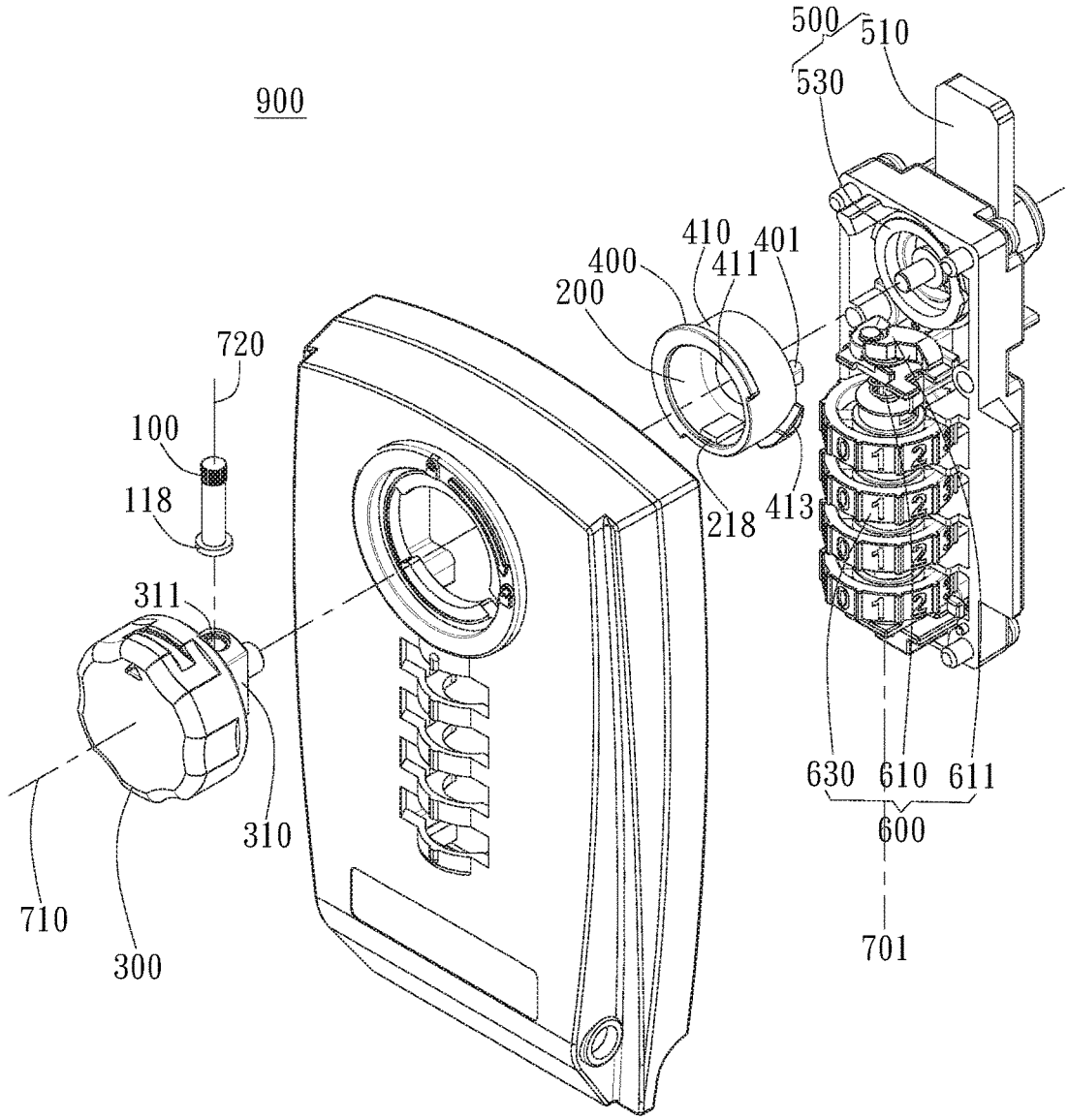
FIGS. 8A and 8B are perspective views of a different embodiment of the knob lock of the present invention.
Figure 8B:
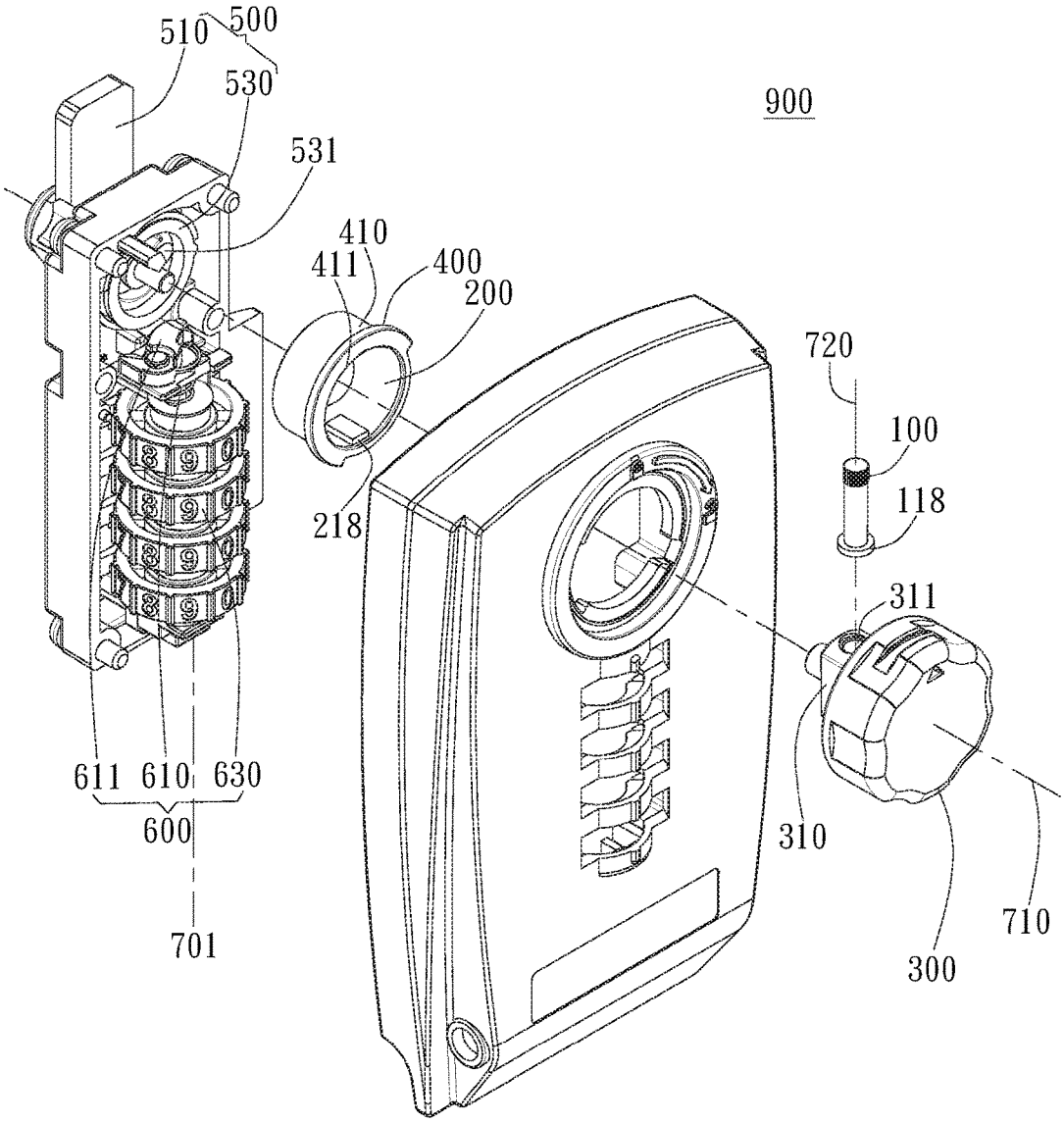

More particularly, as shown in the embodiment in FIGS. 8A and 8B, one side of the knob 300 has a fixed part 310 disposed along the axial direction of the knob 300. The first driving unit 100 is disposed along the radial direction of the knob 300. The opposite ends of the first driving unit 100 are respectively a connecting end 111 and a first magnetic unit 118, wherein the connecting end 111 connects to the fixed part 310. The driving barrel 400 circles the fixed part 310 and the first driving unit 100. The second driving unit 200 includes a second magnetic unit 218 disposed on the inner side 411 of the circular wall 410 of the driving barrel 400. There is a first magnetic attraction force between the first magnetic unit 118 and the second magnetic unit 218. When the lock core 600 is in a locked state, the driving barrel 400 is restricted from rotating by the lock core 600. The knob 300 rotates alone with respect to the driving barrel 400. When the lock core 600 is in an unlocked state, the restriction to the rotation of the driving barrel 400 by the lock core 600 is removed. The first magnetic unit 118 takes the first magnetic attraction force as the driving force to make the second magnetic unit 218 move together with the first magnetic unit 118 and rotates the driving barrel 400. For larger and non-declined magnetic attraction force, the first magnetic unit 118 and the second magnetic unit 218 are preferably rare-earth magnets, such as neodymium magnets or samarium-cobalt magnets.

As shown in the embodiments in FIGS. 2 to 8B, the lock core 600 is a combination lock core. In different embodiments, however, the lock core 600 could be different types of lock core, such as a key lock core, considering the manufacturing and design demand.

Figure 9A:
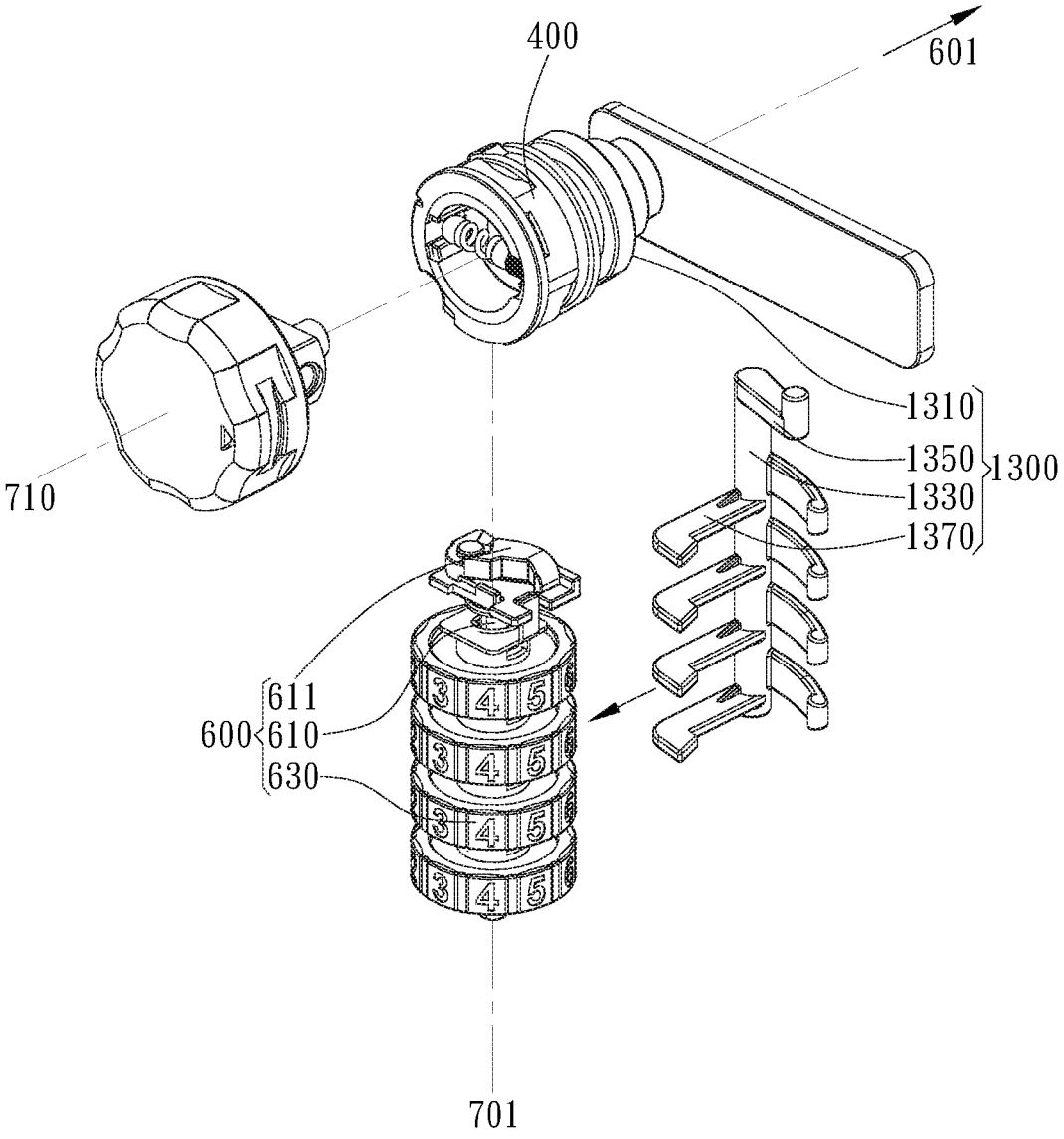
FIGS. 9A to 9C are perspective views of a different embodiment of the knob lock of the present invention having automatic reset function.
Figure 9B:
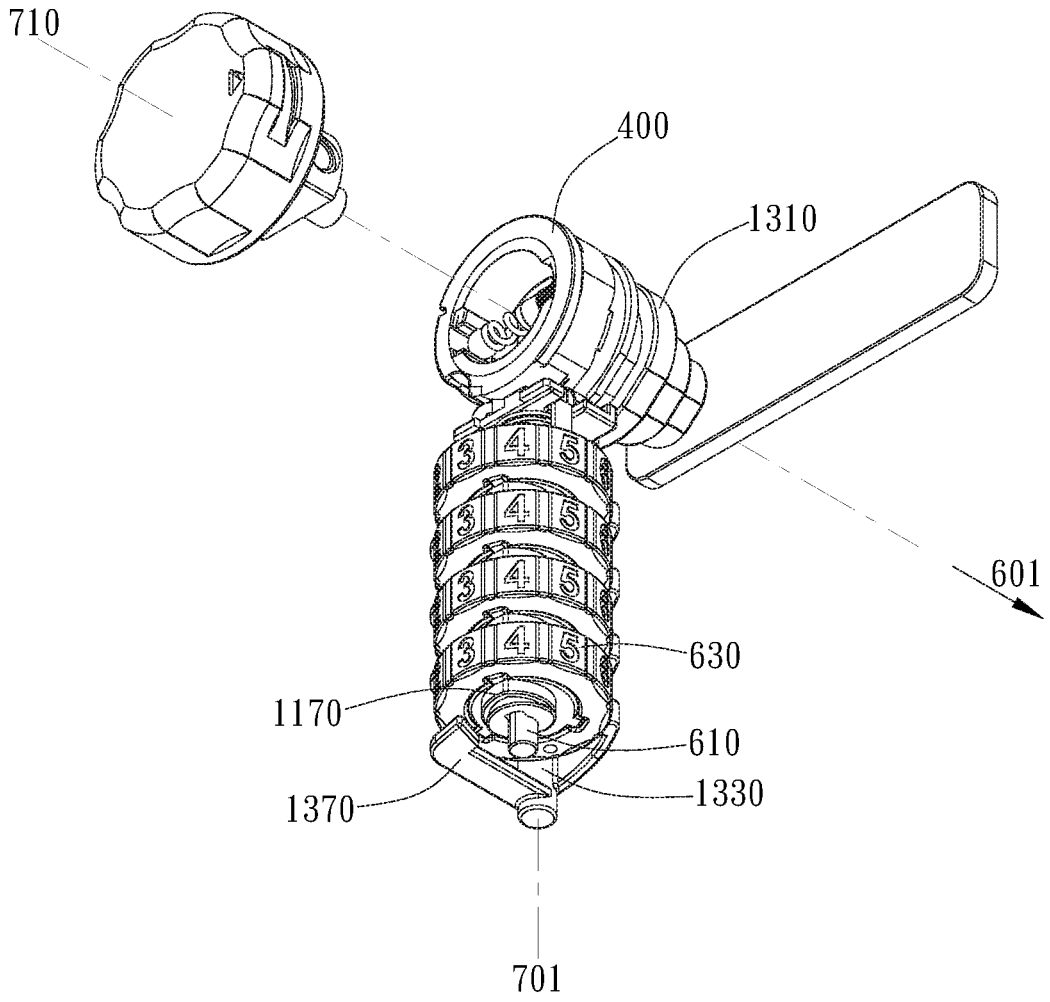
Figure 9C:
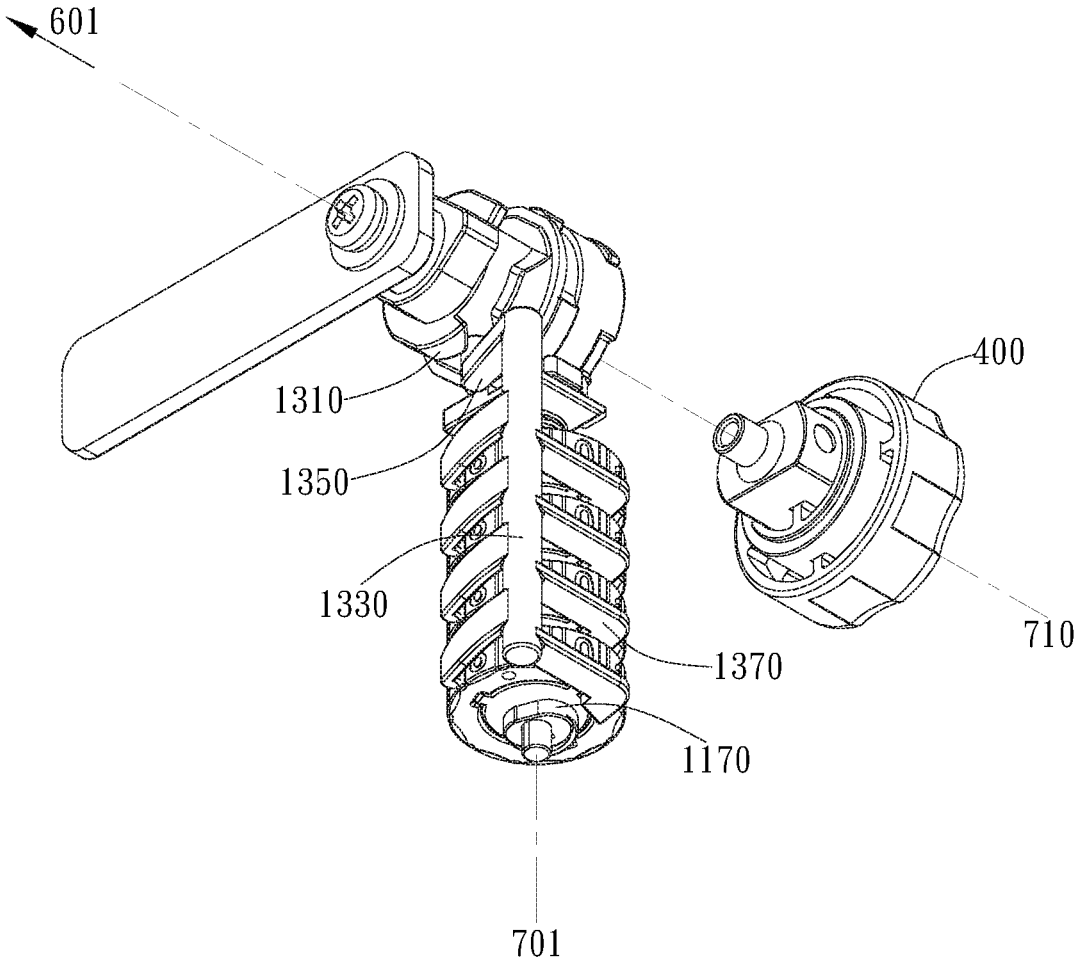

In different embodiments, the knob lock of the present invention further has an automatic reset function. More particularly, as shown in the embodiment in FIGS. 9A to 9C, the driving barrel 400 is able to rotate on its axis which is along a first direction 601. The shaft direction 701 is perpendicular to the first direction 601. The first direction is parallel to the axis 710. The shaft end 611 connects to the driving barrel 400. The lock core 600 further includes a plurality of heart cams 1170 disposed on the combination lock shaft 610 and respectively fixed on one side of the plurality of discs 630. The knob lock 900 further includes a reset device 1300, wherein the reset device 1300 includes a barrel rotating unit 1310, a reset unit shaft 1330, a first arm 1350, and a plurality of second arms 1370. The barrel rotating unit 1310 is pivotally connected to one end of the driving barrel 400, wherein the barrel rotating unit 1310 is able to rotate together with the driving barrel 400 on its axis which is along the first direction 601.

Figure 10:
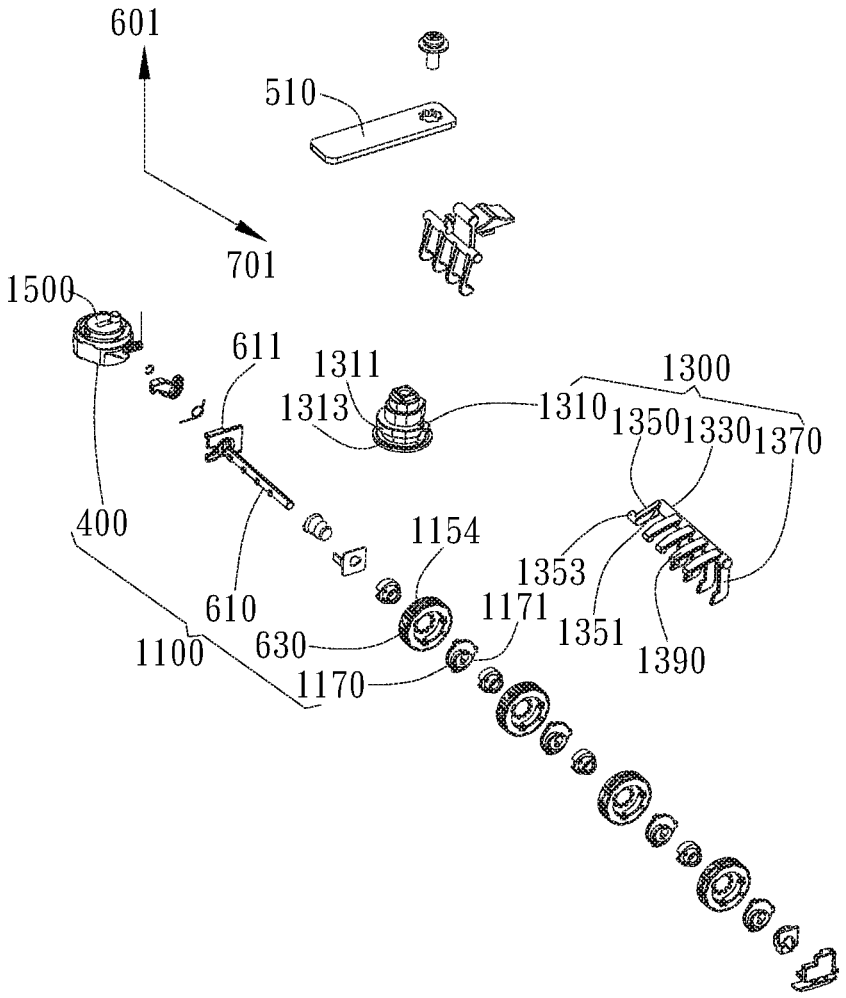
FIG. 10 is an exploded view of the reset device of the knob lock of the present invention.
Figure 11:
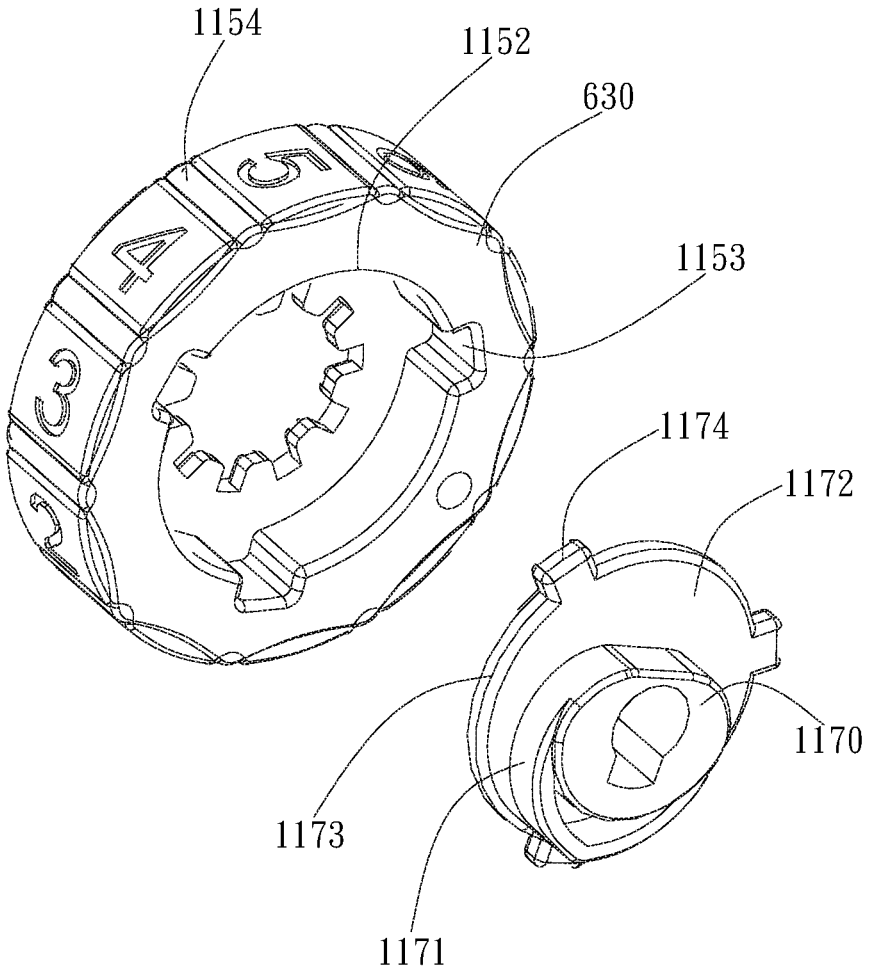
FIG. 11 is a perspective view of the heart cam of the knob lock of the present invention.

More particularly, as shown in the embodiment in FIG. 10, a plurality of heart cams 1170 are disposed on the combination lock shaft 610 and respectively fixed on one side of the plurality of discs 630. As shown in the preferable embodiment in FIG. 11, the outer edge 1171 of the heart cams 1170 fits involute curves. On the other hand, as shown in the embodiment in FIG. 2, the heart cams 1170 are disposed on the attaching plates 1172, wherein the outer edge 1173 of the attaching plates 112 has engaging pins 1174. The heart cam 1170 protrudes out form one side of the disc 630 when the outer edge 1173 of the attaching plates 1172 engages into the inner surface 1152 of the disc 630, wherein the heart cam 1170 is fixed on one side of the disc 630 by the engaging between the engaging pins 1174 and the inner surface 1152 of the disc 630. In different embodiments, however, the disc 630 and the heart cam 1170 could be formed in one piece considering the manufacturing and design demand.

Figure 12:
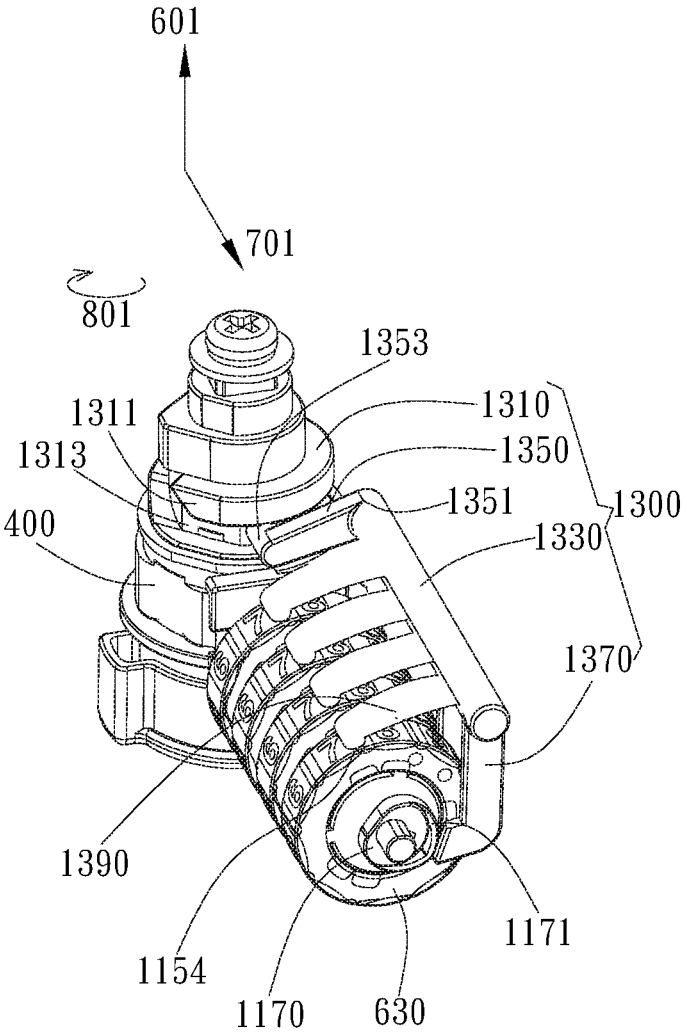
FIGS. 12 to 16B are perspective views showing the movement of the reset device of the knob lock of the present invention.

As shown in the embodiment in FIGS. 10 and 12, the barrel rotating unit 1310 includes an external surface 1311 and a driving slot 1313 disposed on the external surface 1311. The reset unit shaft 1330 extends along the shaft direction 701, wherein the reset unit shaft 1330 is disposed on one side of the plurality of discs 630. One end of the first arm 1350 connects to an end of the reset unit shaft 1330 close to the barrel rotating unit 1310, wherein the other end of the first arm 1350 extends into the driving slot 1313. A plurality of second arms 1370 are respectively disposed outside the plurality of heart cams 1170, wherein the plurality of second arms 1370 are able to engage the outer edges 1171 of the plurality of heart cams 1170. In the preferable embodiment, the thickness of the second arm 1370 is thinner than the gap between the discs for extending into the gaps between the cams 630 and engaging the outer edges 1171 of the plurality of heart cams 1170.

From the above, when the barrel rotating unit 1310 rotates to a reset position, the driving slot 1313 drives the first arm 1350 to make the reset unit shaft 1330 rotate and to make the second arms 1370 engage respectively the outer edges 1171 of the corresponding heart cams 1170. The second arms 1370 apply force to the heart cams 1170 and make the heart cams 1170 bring the respective connected discs 630 to rotate to a pre-determined position. Detailed movement is described below.

Figure 13B:
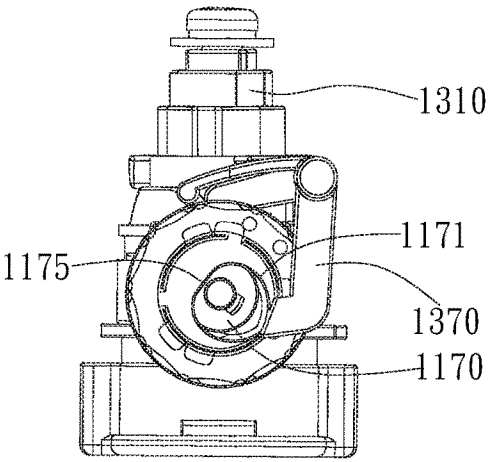
Figure 13A:
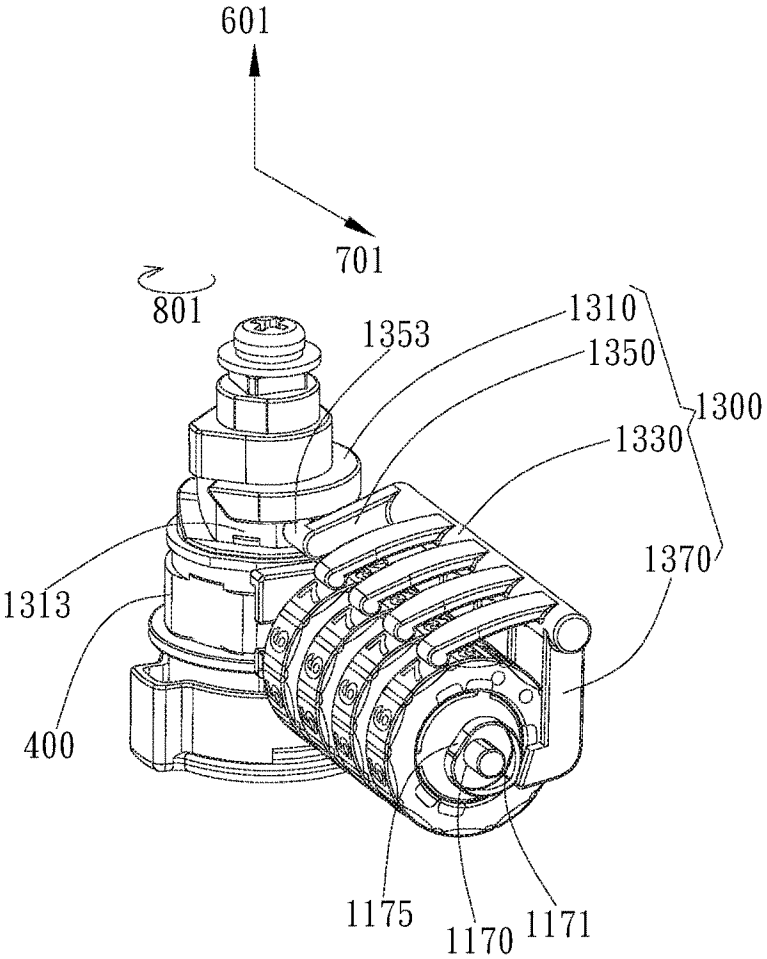

As shown in FIG. 13A, before the barrel rotating unit 1310 rotates to a reset position along direction 801 on its axis which is along the first direction 601, the driving slot 1313 rotates together. At this time, though the other end 1353 of the first arm 1350 moves with respect to the barrel rotating unit 1310 in the driving slot 1313, it is substantially idle with respect to the reset device 1300 or in direction 601. Therefore, it does not make the reset unit shaft 1330 rotate, wherein the second arms 1370 maintain their position outside the corresponding heart cams 1170 without engaging the outer edge 1171 of the heart cams 1170. In other words, the connected first arm 1350, the reset unit shaft 1330, and the second arms 1370 have no actual movement.

Figure 14B:
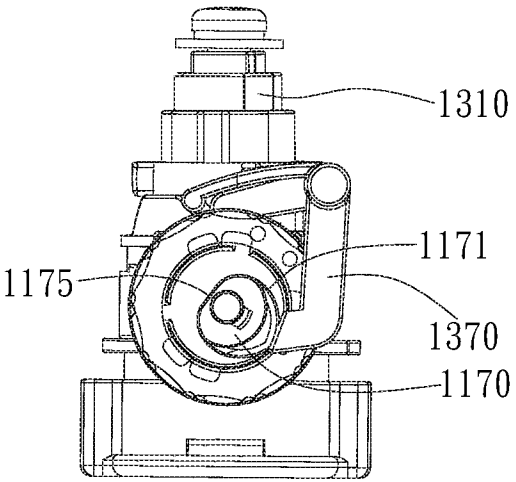
Figure 14A:
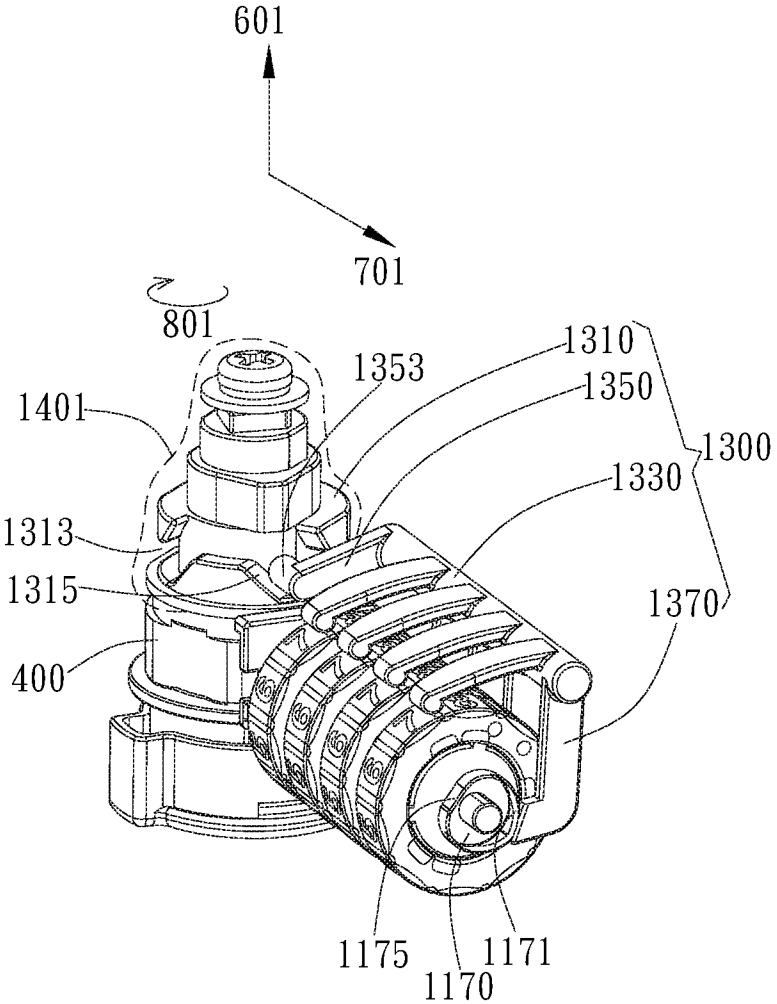

As shown in FIG. 14A, when the barrel rotating unit 1310 rotates to the reset position along direction 801 on its axis which is along the first direction 601, the other end 1353 of the first arm 1350 engages the inner side wall of the driving slot 1313. It not only moves with respect to the barrel rotating unit 1310, but also moves substantially with respect to the reset device 1300 or in direction 601. Since it connects to the reset unit shaft 1330, it makes the reset unit shaft 1330 rotate and makes the second arms 1370 engage the outer edge 1171 of the heart cams 1170. More particularly, a first inclined plane 1315 is formed on the inner side wall of the driving slot 1313. The other end 1353 of the first arm 1350 moves to the first inclined plane 1315 and generates a displacement in direction 601 when the barrel rotating unit 1310 rotates to the reset position 1401. It makes the reset unit shaft 1330 rotate and makes the second arms 1370 engage the outer edge 1171 of the heart cams 1170.

Figure 15B:
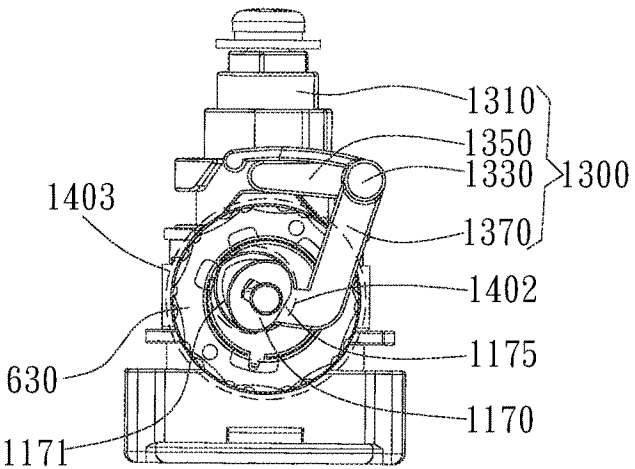
Figure 15A:
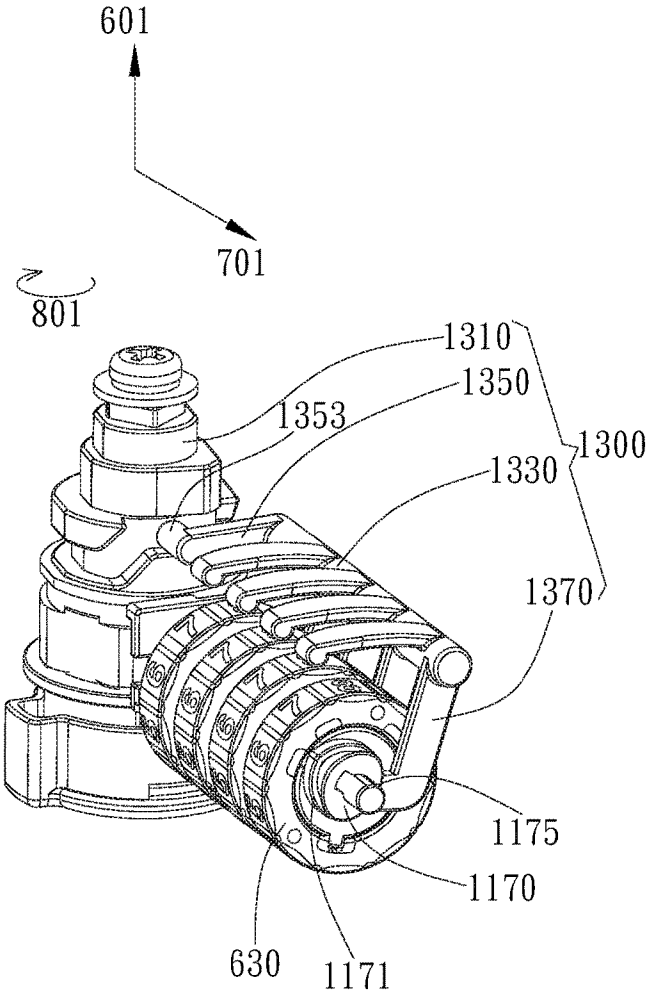

Because the outer edge 1171 of the heart cam 1170 fits involute curves, the heart cam 1170 would rotate to a position for bearing the external force with its dull end 1175 when the external force is applied to the outer edge 1171 of the heart cam 1170. More particularly, as shown in FIGS. 15A and 15B, when the second arms 1370 engage the outer edge 1171 of the heart cam 1170, i.e. the external force is applied on the outer edge 1171 of the heart cam 1170 by the second arms 1370, the heart cam 1170 would rotate to the position 1402 as shown in FIG. 15B due to the mechanical effect generated by that the outer edge 1171 of the heart cam 1170 fitting involute curves, wherein the dull end 1175 engages the second arm 1370 and bears the external force applied by the second arm 1370. Accordingly, the heart cam 1170 is able to bring the connected disc 630 to rotate to the predetermined position 1403.

In the preferred embodiment, the displayed number could be set as "0" when the disc 630 rotates to the predetermined position 1403. In other words, form the above, when the user rotates the driving barrel to make the barrel rotating unit rotate to the reset position, the driving slot drives the first arm to make the reset unit shaft rotate and to make the second arms engage respectively the outer edges of the corresponding heart cams, wherein the second arms apply force on the heart cams and make the heart cams bring the corresponding connected discs to rotate to the predetermined position displaying "0". Accordingly, the knob lock is reset without the user resetting it or mixing up the discs manually.

Figure 16B:
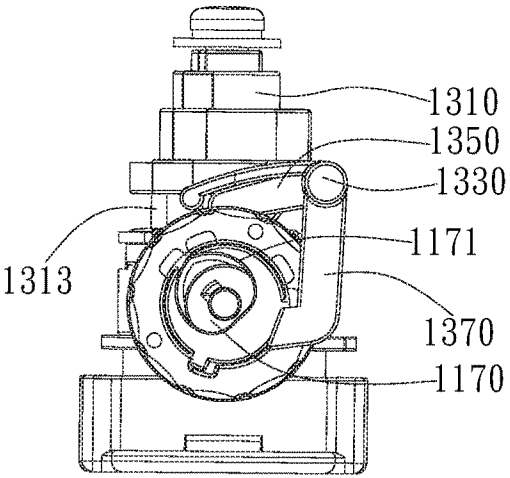
Figure 16A:
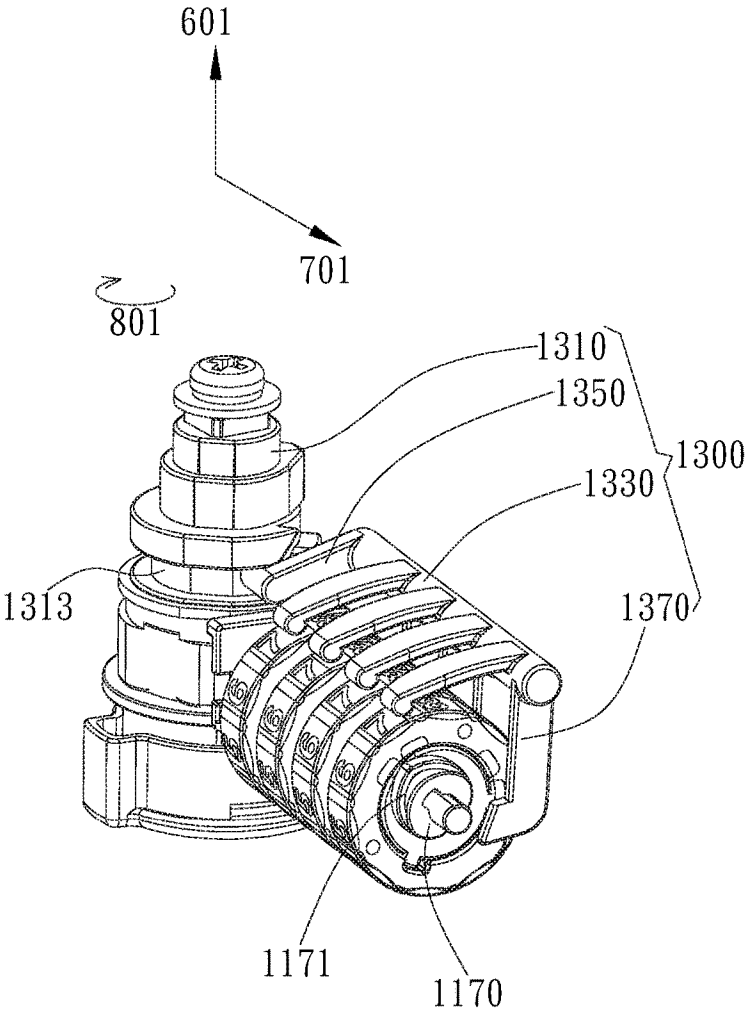

On the other hand, as shown in FIGS. 16A and 16B, when the barrel rotating unit 1310 continuously rotates along the third direction 801 and leaves the reset position 1401, the other end 1353 of the first arm 1350 continuously moves with respect to the barrel rotating unit 1310 in the driving slot 1313, wherein it is substantially idle with respect to the reset device 1300 or in direction 601. Thus, the first arm 1350, the reset unit shaft 1330, and the second arms 1370 are substantially idle.

Figure 17:
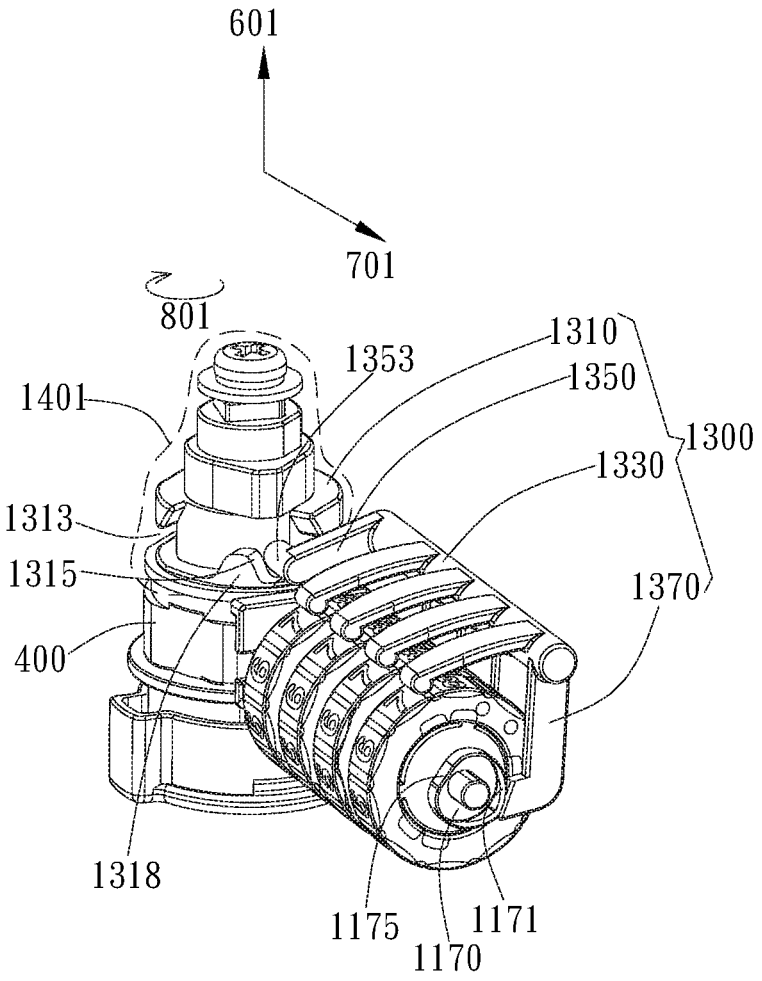
FIG. 17 is a perspective view of the reset device of the knob lock of the present invention in a different embodiment.

As shown in the embodiment in FIG. 14A, a first inclined plane 1315 is formed on the inner side wall of the driving slot 1313. In different embodiments, however, it could have different setup to replace the first inclined plane 1315 considering the manufacturing and design demand. As shown in a different embodiment in FIG. 17, a slot protruding portion 1318 is formed on the inner side wall of the driving slot 611. The other end 1353 of the first arm 1350 moves to the slot protruding portion 1318 when the barrel rotating unit 1310 rotates to the reset position. This makes the reset unit shaft 1330 rotate, hence brings the second arm 1370 to engage the outer edge 1171 of the heart cam 1170. More particularly, as to either the first inclined plane 1315 or the slot protruding portion 1318, the key point is to make the other end 1353 of the first arm 1350 generate a displacement in direction 601, which makes the reset unit shaft 1330 rotate and hence brings the second arm 1370 to engage the outer edge 1171 of the heart cam 1170.

As shown in FIGS. 10 and 12, the reset device 1300 further includes a plurality of engaging arms 1390 respectively disposed outside the plurality of discs 630. The plurality of engaging arms 1390 are able to engage the external surfaces of the plurality of discs 630. The engaging arms 1390 are elastic and are able to provide a first resistance to the rotating of the discs 1390. The external surfaces of the discs 630 further have a plurality of concave portions 1154. The engaging arms 1390 are able to provide a second resistance to the rotating of the discs 630 when one end of each of the engaging arms 1390 engages the concave portion 1154, wherein the second resistance is larger than the first resistance. More particularly, as the plurality of engaging arms 1390 engages the external surfaces of the plurality of discs 630, a first resistance to the rotating of the discs 1390 is provided to avoid the random rotation of the discs 630 and to increase the handle of the user in rotating the discs 630. The engaging arms 1390 are able to provide a second resistance larger than the first resistance to the rotating of the discs 630 when one end of each of the engaging arms 1390 engages the concave portion 1154, which makes the discs 630 stop in a position between the numbers more precisely.

Figure 18A:
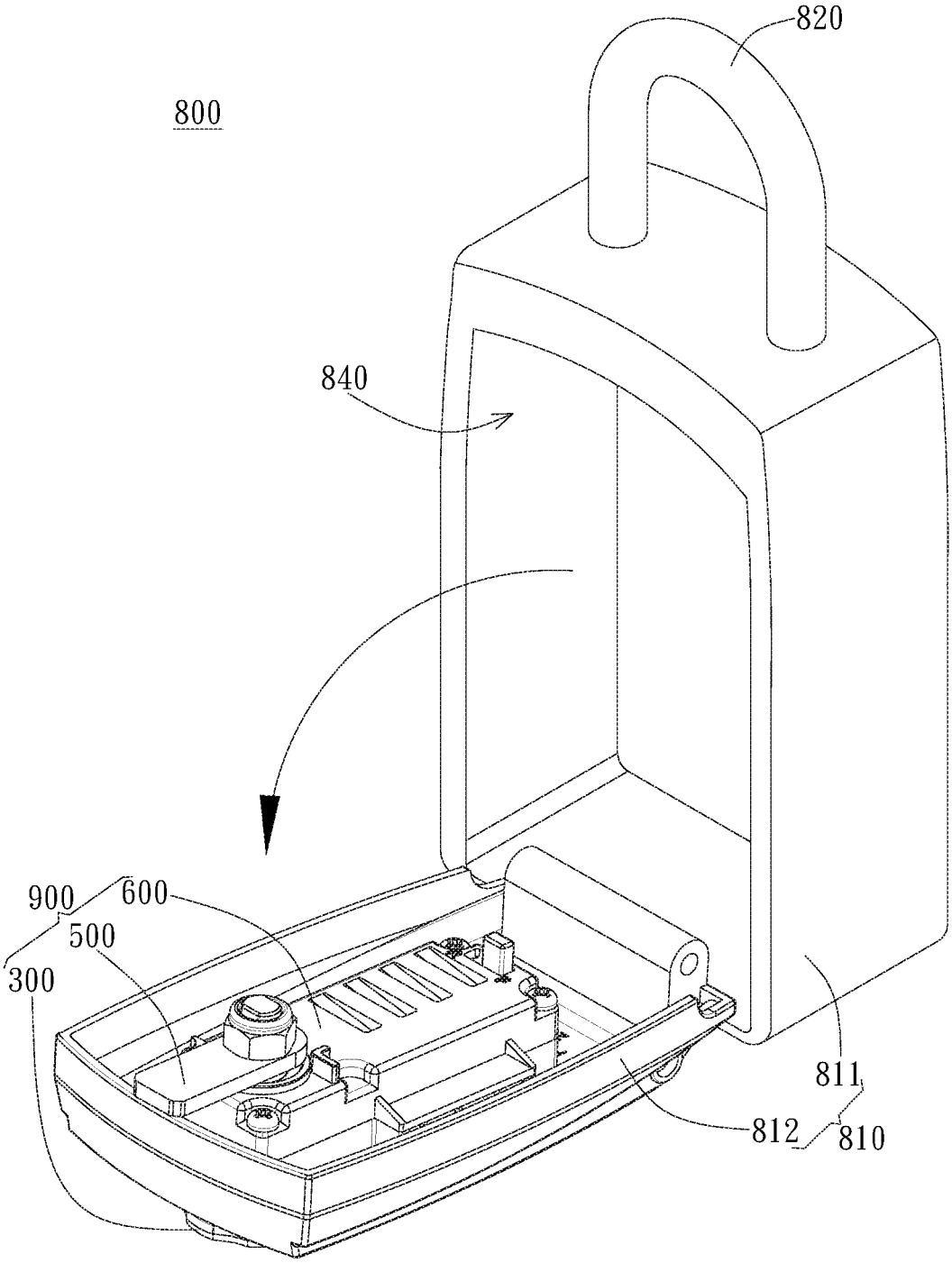
FIGS. 18A and 18B are perspective views of an embodiment using the knob lock of the present invention in a lock box.
Figure 18B:
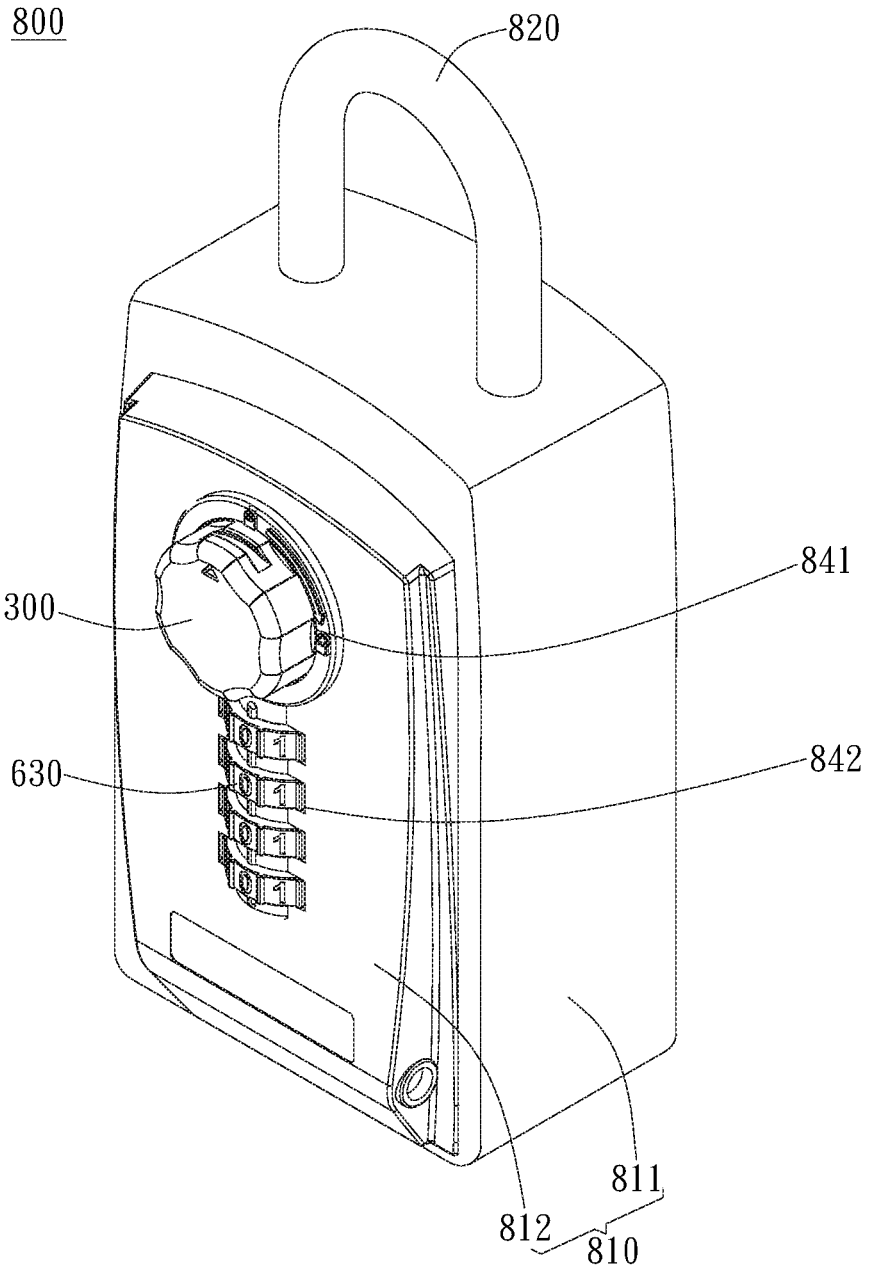

On the other hand, as shown in the embodiment in FIGS. 18A and 18B, the knob lock 900 can be used in a lock box 800. The lock box 800 includes a box 810, a hook device 820, and a knob lock 900. The box 810 includes a concave body 811 and a front cover 812. The front cover 812 forms an accommodating space 840 with the concave body 811. The bottom edge of the front cover 812 connects pivotally to the bottom side of the concave body 811. The front cover 812 is able to rotate to open with respect to the concave body 811. The front cover 812 has a knob opening 841 and a plurality of disc openings 842. The hook device 820 is disposed at the top of the concave body 811. The knob lock 900 is disposed in the inner side of the front cover 812. The knob 300 and the plurality of discs 630 are at least partially exposed by the knob opening 841 and the disc openings 842. When the lock core 600 is in an unlocked state, the knob 300 makes the lock unit 500 rotate together while the knob 300 rotates and makes the hook device 820 unlock. The description regarding the mechanism and movement of rotating the lock unit 500 to make the hook device 820 unlocked are skipped over since they belong to prior arts.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A knob lock, comprising:

a knob being able to rotate on its axis which is along a first direction;

a first driving unit disposed on the knob;

a driving barrel disposed in one side of the knob, wherein the driving barrel is able to rotate on its axis which is along the first direction;

a second driving unit disposed on the driving barrel;

a lock unit disposed on the other side of the driving barrel with respect to the knob, wherein the lock unit rotates together with the driving barrel;

a combination lock shaft disposed along a shaft direction perpendicular to the first direction, wherein one end of the combination lock shaft connects to the driving barrel;

a plurality of discs disposed on the combination lock shaft;

a plurality of heart cams disposed on the combination lock shaft and respectively fixed on one side of the plurality of discs;

a barrel rotating unit pivotally connected to one end of the driving barrel, wherein the barrel rotating unit is able to rotate together with the driving barrel on its axis which is along the first direction, wherein the barrel rotating unit includes an external surface and a driving slot disposed on the external surface;

a reset unit shaft extending along the shaft direction, wherein the reset unit shaft is disposed on one side of the plurality of discs;

a first arm, wherein one end of the first arm connects to an end of the reset unit shaft close to the barrel rotating unit, wherein the other end of the first arm extends into the driving slot; and a plurality of second arms respectively disposed outside the plurality of heart cams, wherein the plurality of second arms are able to engage the outer edges of the plurality of heart cams;

wherein:

when the knob lock is in a locked state, the driving barrel is restricted from rotating, the knob rotates alone with respect to the driving barrel without engaging the driving barrel;

when the knob lock is in an unlocked state, the restriction to the rotation of the driving barrel is removed, the first driving unit applies a driving force on the second driving unit when the knob rotates, the driving force drives the driving barrel rotate to make the lock unit rotate together;

when the barrel rotating unit rotates to a reset position, the driving slot drives the first arm to make the reset unit shaft rotate and to make the second arms engage respectively the outer edges of the corresponding heart cams, the second arms apply force to the heart cams and make the heart cams bring the respective connected discs to rotate to a pre-determined position.

2. The knob lock of claim 1, the outer edge of the heart cams fit involute curves.

3. The knob lock of claim 1, a first inclined plane is formed on the inner side wall of the driving slot, the other end of the first arm moves to the first inclined plane when the barrel rotating unit rotates to the reset position.

4. The knob lock of claim 1, a slot protruding portion is formed on the inner side wall of the driving slot, the other end of the first arm moves to the slot protruding portion when the barrel rotating unit rotates to the reset position.

5. The knob lock of claim 1, further includes a plurality of engaging arms respectively disposed outside the plurality of discs, wherein the plurality of engaging arms are able to engage the external surfaces of the plurality of discs, the engaging arms are elastic and are able to provide a first resistance to the rotating of the discs.

6. The knob lock of claim 5, wherein the external surfaces of the discs further have a plurality of concave portions, the engaging arms are able to provide a second resistance to the rotating of the discs when one end of each of the engaging arms engages the concave portion, wherein the second resistance is larger than the first resistance.

7. A lock box, comprising a box, including:

a concave body;

a front cover forming an accommodating space with the concave body, the bottom edge of the front cover connects pivotally to the bottom side of the concave body, the front cover is able to rotate to open with respect to the concave body, the front cover has a knob opening and a plurality of disc openings;

a hook device disposed at the top of the concave body;

the knob lock of claim 1, wherein the knob lock is disposed in the inner side of the front cover, the knob and the plurality of discs are at least partially exposed by the knob opening and the disc openings, when the knob lock is in an unlocked state, the knob makes the lock unit rotate together while the knob rotates and makes the hook device unlock.

8. A knob lock, comprising:

a knob;

a first driving unit disposed on the knob;

a driving barrel disposed on one side of the knob, wherein the driving barrel and the knob are able to rotate on the same axis;

a second driving unit disposed on the driving barrel;

a lock unit disposed on the other side of the driving barrel with respect to the knob, wherein the lock unit rotates together with the driving barrel;

a lock core disposed beside the driving barrel;

wherein:

when the lock core is in a locked state, the driving barrel is restricted from rotating by the lock core, and the knob rotates alone with respect to the driving barrel without engaging the driving barrel;

when the lock core is in an unlocked state, the restriction to the rotation of the driving barrel by the lock core is removed, the first driving unit applies a driving force on the second driving unit when the knob rotates, and the driving force rotates the driving barrel to make the lock unit rotate together.

9. The knob lock of claim 8, wherein:

one side of the knob has a fixed part disposed along the axial direction of the knob, the first driving unit is disposed along the radial direction of the knob, the first driving unit includes an elastic unit, the opposite ends of the elastic unit are respectively a connecting end and a driving end, the connecting end connects to the fixed part;

the driving barrel circles the fixed part and the first driving unit, the second driving unit forms a concave on the inner side of the circular wall of the driving barrel, the driving end extends into the concave;

when the lock core is in a locked state, the driving barrel is restricted from rotating by the lock core, the knob rotates alone with respect to the driving barrel and makes the driving end depart from the concave; when the lock core is in an unlocked state, the restriction to the rotation of the driving barrel by the lock core is removed, the driving end applies a force on the side wall of the concave to generate the driving force to rotate the driving barrel.

10. The knob lock of claim 9, wherein the elastic unit includes a spring, wherein a ball is disposed at one end of the spring to serve as the driving end.

11. The knob lock of claim 8, wherein:

one side of the knob has a fixed part disposed along the axial direction of the knob, the first driving unit is disposed along the radial direction of the knob, the opposite ends of the first driving unit are respectively a connecting end and a first magnetic unit, the connecting end connects to the fixed part;

the driving barrel circles the fixed part and the first driving unit, the second driving unit includes a second magnetic unit disposed on the inner side of the circular wall of the driving barrel, there is a first magnetic attraction force between the first magnetic unit and the second magnetic unit;

when the lock core is in a locked state, the driving barrel is restricted from rotating by the lock core, the knob rotates alone with respect to the driving barrel; when the lock core is in an unlocked state, the restriction to the rotation of the driving barrel by the lock core is removed, the first magnetic unit takes the first magnetic attraction force as the driving force to make the second magnetic unit move together with the first magnetic unit and rotates the driving barrel.

12. The knob lock of claim 8, wherein:

the lock unit includes:

a tongue piece;

a lock barrel disposed in the other side of the driving barrel with respect to the knob, the lock barrel and the driving barrel are able to rotate on the same axis, one side of the lock barrel facing the driving barrel has an inserting hole, the other side of the lock barrel with respect to the driving barrel connects to the tongue piece;

the other side of the driving barrel with respect to the knob has an inserting pin, wherein the inserting pin inserts into the inserting hole.

13. The knob lock of claim 8, wherein:

the lock core includes:

a combination lock shaft disposed along a shaft direction, wherein the combination lock shaft has a shaft end; and a plurality of discs disposed respectively on the combination lock shaft;

the shaft end engages the outer side of the circular wall of the driving barrel, wherein the outer side of the circular wall of the driving barrel has a driving protruding portion;

when the lock core is in a locked state, the movement of the combination lock shaft along the shaft direction is restricted, the pushing of the combination lock shaft by the driving protruding portion is stopped to restrict the driving barrel from rotating; when the lock core is in an unlocked state, the driving protruding portion is able to push the combination lock shaft to move along the shaft direction while the driving barrel rotates.

14. The knob lock of claim 13, wherein:

the driving barrel is able to rotate on its axis which is along a first direction, wherein the shaft direction is perpendicular to the first direction, the shaft end connects to the driving barrel;

the lock core further includes a plurality of heart cams disposed on the combination lock shaft and respectively fixed on one side of the plurality of discs;

the knob lock further includes a reset device, wherein the reset device includes:

a barrel rotating unit pivotally connecting to one end of the driving barrel, wherein the barrel rotating unit is able to rotate together with the driving barrel on its axis which is along the first direction, wherein the barrel rotating unit includes an external surface and a driving slot disposed on the external surface;

a reset unit shaft extending along the shaft direction, wherein the reset unit shaft is disposed on one side of the plurality of discs;

a first arm, wherein one end of the first arm connects to an end of the reset unit shaft close to the barrel rotating unit, wherein the other end of the first arm extends into the driving slot; and a plurality of second arms respectively disposed outside the plurality of heart cams, wherein the plurality of second arms are able to engage the outer edges of the plurality of heart cams;

wherein when the barrel rotating unit rotates to a reset position, the driving slot drives the first arm to make the reset unit shaft rotate and to make the second arms engage respectively the outer edges of the corresponding heart cams, the second arms apply force to the heart cams and make the heart cams bring the respective connected discs to rotate to a pre-determined position.

* * * * *